US008888542B2

(12) United States Patent
Kinpara et al.

(10) Patent No.: US 8,888,542 B2
(45) Date of Patent: Nov. 18, 2014

(54) ELECTRIC OUTBOARD MOTOR

(75) Inventors: Masatoshi Kinpara, Hamamatsu (JP); Yohei Nakano, Hamamatsu (JP); Satoru Takahashi, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 134 days.

(21) Appl. No.: 13/589,056

(22) Filed: Aug. 17, 2012

(65) Prior Publication Data

US 2013/0045648 A1 Feb. 21, 2013

(30) Foreign Application Priority Data

Aug. 18, 2011 (JP) ..... 2011-179048
Oct. 14, 2011 (JP) ..... 2011-226965

(51) Int. Cl.

*B60L 11/00* (2006.01)
*B63H 21/17* (2006.01)
*B63H 20/00* (2006.01)
*B63H 20/32* (2006.01)

(52) U.S. Cl.

CPC ..... *B63H 20/00* (2013.01); *B63H 21/17* (2013.01); *B63H 20/32* (2013.01); *B63H 20/007* (2013.01)
USPC ..... 440/6; 440/1

(58) Field of Classification Search

USPC ..... 440/6
See application file for complete search history.

(56) References Cited

U.S. PATENT DOCUMENTS 5,041,029 A * 8/1991 Kulpa ..... 440/1
5,112,256 A * 5/1992 Clement ..... 440/7
5,967,863 A * 10/1999 Marchant ..... 440/6
6,352,456 B1 * 3/2002 Jaszewski et al. ..... 440/53
6,688,927 B2 * 2/2004 Aarnivuo ..... 440/58
6,758,705 B1 * 7/2004 Bechtel et al. ..... 440/7
6,855,016 B1 * 2/2005 Jansen ..... 440/6

(Continued)

FOREIGN PATENT DOCUMENTS

JP 2005-162055 6/2005
JP 2006-056458 3/2006
JP 2011-016388 1/2011

OTHER PUBLICATIONS

European Search Report, dated Dec. 17, 2012, which issued during the prosecution of European Patent Application No. 12180820.8, which corresponds to the present application.

(Continued)

*Primary Examiner* — Lars A Olson
*Assistant Examiner* — Jovon Hayes
(74) *Attorney, Agent, or Firm* — Troutman Sanders LLP

(57) ABSTRACT

Provided is an electric outboard motor that includes a drive motor, which is an AC motor, as a drive source. The electric outboard motor includes: an outboard motor main body that includes the drive motor and an inverter that converters a direct current to an alternating current to supply the alternating current to the drive motor; a control/power supply unit that is formed separately from the outboard motor main body and that can supply the direct current to the inverter; and a connection cable that electrically connects the outboard motor main body and the control/power supply unit. The inverter and the drive motor are stacked and arranged in an axial direction of a rotation output axis of the drive motor. Part of the inverter falls within an outline of the drive motor in a view in the axial direction of the rotation output axis of the drive motor.

11 Claims, 12 Drawing Sheets

(56) References Cited

U.S. PATENT DOCUMENTS

| | | | | |
|---|---|---|---|---|
| 6,986,688 | B1 * | 1/2006 | Jansen | 440/1 |
| 7,163,427 | B1 * | 1/2007 | Lee | 440/6 |
| 7,249,984 | B2 * | 7/2007 | Kobayashi et al. | 440/6 |
| 7,473,148 | B2 * | 1/2009 | Ichikawa et al. | 440/6 |
| 7,594,833 | B2 * | 9/2009 | Oishi et al. | 440/55 |
| 7,637,790 | B1 * | 12/2009 | Guerra | 440/6 |
| 2003/0194921 | A1 * | 10/2003 | Leiss et al. | 440/6 |
| 2006/0012248 | A1 * | 1/2006 | Matsushita et al. | 307/10.1 |
| 2006/0040573 | A1 * | 2/2006 | Kobayashi et al. | 440/84 |
| 2007/0173140 | A1 * | 7/2007 | Boebel | 440/6 |
| 2007/0197107 | A1 * | 8/2007 | Lee | 440/6 |
| 2008/0085641 | A1 * | 4/2008 | Williams | 440/6 |
| 2009/0075532 | A1 * | 3/2009 | Oishi et al. | 440/1 |
| 2011/0244740 | A1 * | 10/2011 | Daikoku et al. | 440/6 |
| 2013/0045648 | A1 * | 2/2013 | Kinpara et al. | 440/6 |

OTHER PUBLICATIONS

Extended European Search Report, dated Feb. 27, 2013, which issued during the prosecution of European Patent Application No. 12180820.8, which corresponds to the present application.

Japanese Office Action dated Sep. 16, 2014, which issued during prosecution of Japanese Application No. 2011-179048, which corresponds to the present application.

* cited by examiner

ELECTRIC OUTBOARD MOTOR

CROSS-REFERENCE TO RELATED APPLICATIONS

This application is based upon and claims the benefit of priority of the prior Japanese Patent Application Nos. 2011-179048, filed on Aug. 18, 2011, and 2011-226965, filed on Oct. 14, 2011, the entire contents of which are incorporated herein by reference.

BACKGROUND OF THE INVENTION

1. Field of the Invention

The present invention relates to an electric outboard motor. The present invention particularly relates to an electric outboard motor including an AC motor as a drive source and an inverter that supplies an alternating current to the AC motor.

2. Description of the Related Art

In recent years, an electric outboard motor is drawing attention to reduce the environmental load. For example, Patent Document 1 discloses an electric outboard motor including a motor as a drive source, a battery that supplies power to the motor, and a control unit that controls the motor. In the electric outboard motor, rotational force output by the motor is transmitted to a propeller through a drive shaft, a bevel gear, and a propeller shaft. The propeller rotates to generate driving force. The electric outboard motor also has a motor cover including a lower motor cover and an upper motor cover. The motor, the battery, and the control unit are accommodated in the motor cover. Since the exhaust gas is not discharged into water, the electric outboard motor can reduce the environmental load, compared to an outboard motor that includes, for example, an internal combustion engine as a drive source.

In a configuration with an AC motor as a drive motor, an inverter needs to convert a direct current supplied from the battery to an alternating current to drive the AC motor. Therefore, the inverter and the drive motor need to be electrically connected. If the battery is arranged on a ship separately from an outboard motor main body, the battery and the outboard motor need to be electrically connected by a connection cable. If wires or cables are routed in the outboard motor, a ship operator or a foreign matter may touch the wires or cables, and the wires or cables may be damaged.

In the electric outboard motor described in Patent Document 1, the control unit and the battery that are heavy in weight are arranged at positions away from the center of steering. The configuration increases a moment of inertia around a steering shaft, and great power is required for a steering operation. Therefore, the steering operation cannot be performed quickly. The control unit is arranged on the front side of the motor. Therefore, the control unit projects inside of the ship, and the space of the ship is compressed. Even if the control unit and the battery are arranged on the side of the motor, the moment of inertia around the steering shaft is not reduced. If the angle of steering is large, the control unit and the battery enter the space on the ship, and the space on the ship is compressed.

[Patent Document 1] Japanese Laid-open Patent Publication No. 2005-162055

SUMMARY OF THE INVENTION

In view of the circumstances, objects of the present invention are to improve operability of an electric outboard motor, to provide an electric outboard motor that does not compress a space on a ship in a steering operation, to provide an electric outboard motor that makes is difficult for a ship operator or a foreign matter to touch wires or cables that supply power for driving a drive motor, and to provide an electric outboard motor that can prevent or suppress a ship operator or a foreign matter from touching wires or cables that supply power for driving the drive motor to damage the wires or cables.

To solve the problems, the present invention provides an electric outboard motor that includes an AC motor as a drive source, the electric outboard motor including: an outboard motor main body that includes the AC motor and an inverter that converts a direct current to an alternating current to supply the alternating current to the AC motor; a control/power supply unit that is formed separately from the outboard motor main body and that supplies the direct current to the inverter; and a connection cable that electrically connects the outboard motor main body and the control/power supply unit, wherein the inverter and the AC motor are stacked and arranged in an axial direction of a rotation output axis of the AC motor, and part of the inverter falls within an outline of the AC motor in a view in the axial direction of the rotation output axis of the AC motor.

The rotation output axis falls within an outline of the inverter in a view in the axial direction of the rotation output axis of the AC motor.

A steering handle that steers the outboard motor main body is installed on a housing of the AC motor, and the inverter falls within the outline of the AC motor in a view in the axial direction of the rotation output axis of the AC motor, except for an end section positioned on an opposite side of a side where the steering handle is installed across the rotation output axis of the AC motor.

A bracket is arranged on the housing of the AC motor, a mounting boss that rises to an opposite side of extension of the rotation output axis of the AC motor is arranged on the bracket, and the inverter is installed on the AC motor through the mounting boss.

A width direction dimension of the inverter is smaller than a width direction dimension of the AC motor, and a connection section that connects, to the inverter, a power line that supplies the direct current from the control/power supply unit to the inverter is arranged on a side of the inverter in a view in the axial direction of the rotation output axis of the AC motor.

DETAILED DESCRIPTION OF THE PREFERRED EMBODIMENTS

Figure 1:
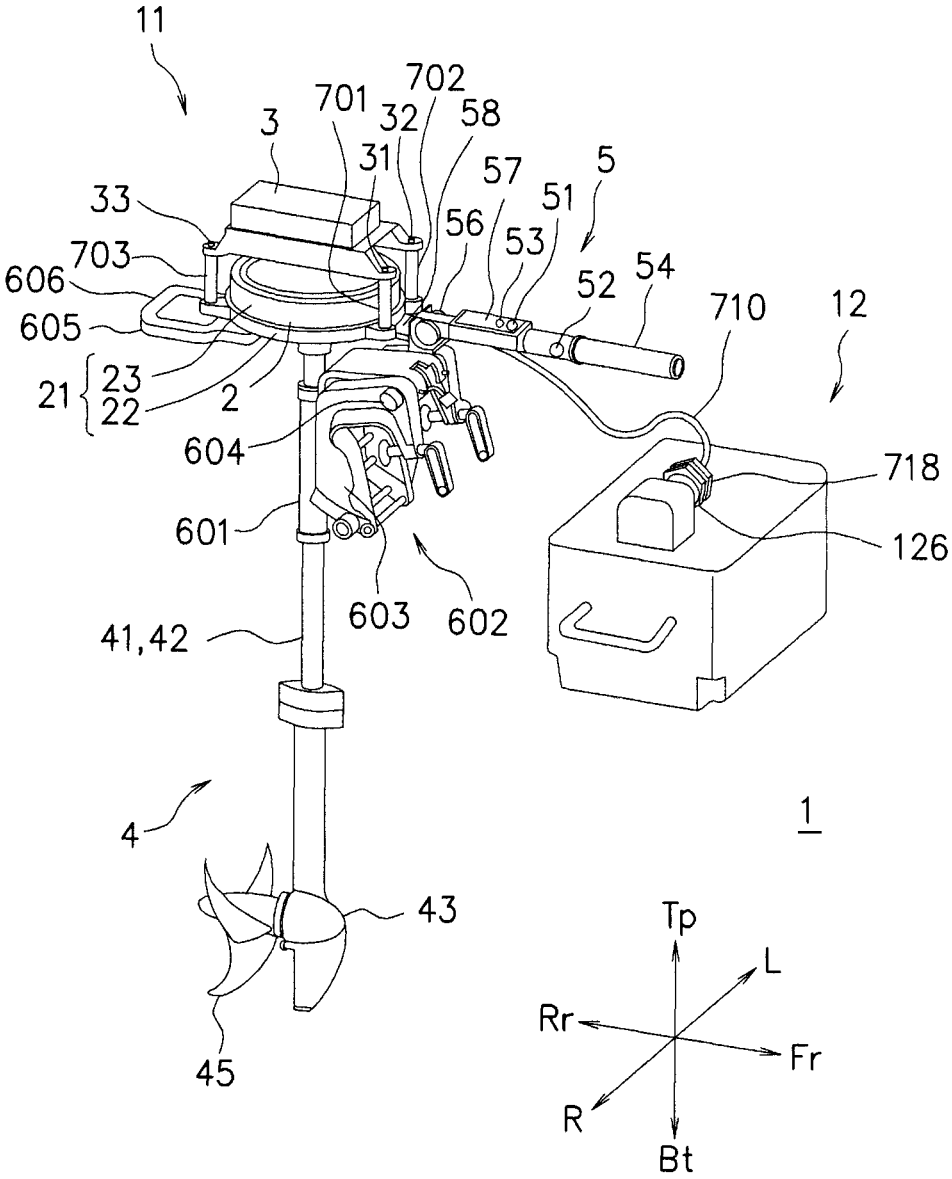
FIG. 1 is an external perspective view schematically showing a configuration of an electric outboard motor according to an embodiment of the present invention.

An embodiment of the present invention will be described in detail with reference to the drawings. An electric outboard motor according to the embodiment of the present embodiment is mounted and used in a ship. For the convenience of the description, the electric outboard motor according to the embodiment of the present invention will be called "the outboard motor". Directions "front", "rear", "right", "left", "top", and "bottom" of the outboard motor is based on directions of the ship on which the outboard motor is mounted. In the drawings, a front side of the outboard motor is indicated by an arrow Fr as necessary, a rear side is indicated by an arrow Rr, a top side is indicated by an arrow Tp, a bottom side is indicated by an arrow Bt, a right side is indicated by an arrow R, and a left side is indicated by an arrow L. When the outboard motor main body is mounted on the ship, the right side of the outboard motor main body is a starboard side of the ship, and the left side of the outboard motor main body is a port side of the ship.

Figure 2:
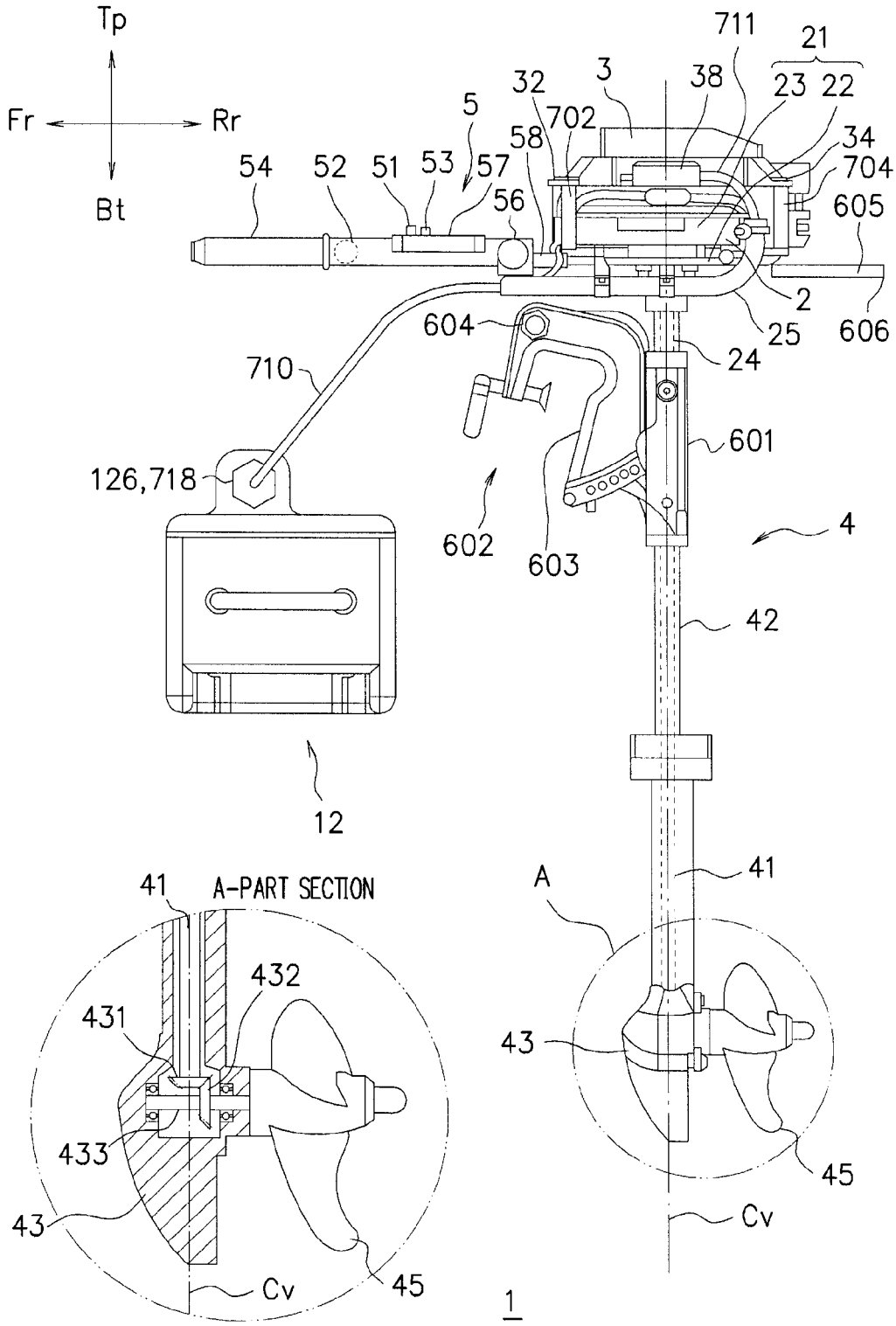
FIG. 2 is a side view schematically showing a configuration of the electric outboard motor according to the embodiment of the present invention.

An overall configuration of the outboard motor 1 will be described with reference to FIGS. 1 and 2. FIG. 1 is an external perspective view schematically showing a configuration of the outboard motor 1. FIG. 2 is a side view schematically showing the configuration of the outboard motor 1. As shown in FIGS. 1 and 2, the outboard motor 1 includes an outboard motor main body 11 and a control/power supply unit 12. The outboard motor main body 11 and the control/power supply unit 12 are separate bodies and are electrically connected by a connection cable 710. The outboard motor main body 11 is installed on a stern (for example, a Trans Am board 91 of a ship 9 (see FIG. 12)) or the like in use. The control/power supply unit 12 supplies (transmits) driving power (direct current here) to the outboard motor main body 11. The control/power supply unit 12 also controls the outboard motor 1. Since the outboard motor main body 11 and the control/power supply unit 12 are separate bodies, the weight of the outboard motor main body 11 can be reduced. Therefore, the operability of the outboard motor main body 11 can be improved. Particularly, the moment of inertia of the outboard motor main body 11 is reduced, and a steering operation can be performed quickly. The position of arrangement of the control/power supply unit 12 is not limited. Therefore, the control/power supply unit 12 can be arranged at a position away from the outboard motor main body 11, such as a position where the weight balance of the ship 9 is stable. Therefore, the stability of the ship 9 can be improved. The control/power supply unit 12 can be arranged at a location in the ship 9 not exposed to water (or unlikely to be exposed to water). Therefore, wetting of the control/power supply unit 12 can be prevented or suppressed.

As shown in FIGS. 1 and 2, the outboard motor main body 11 includes a drive motor 2, an inverter 3, a drive unit 4, an installation unit 602, and a steering handle 5.

The drive motor 2 is a drive source for rotating a drive propeller 45 of the drive unit 4. For example, an AC motor such as a three-phase AC induction motor is applied to the drive motor 2. The drive motor 2 includes a motor housing 21. The motor housing 21 is a member that serves as a case of the drive motor 2. The motor housing 21 includes a lower housing 22 and an upper housing 23 that can be divided in an axial direction (vertical direction here) of a rotation output axis 24. In the motor housing 21, the lower housing 22 and the upper housing 23 are combined to secure waterproofing (watertightness). In this way, since the motor housing 21 of the drive motor 2 is waterproof, the drive motor 2 can be arranged to be exposed to the outside and to be subjected to direct exposure to the open air. Therefore, a cooling mechanism of the drive motor 2 can be simplified. For example, an air-cooled cooling mechanism can be applied to the drive motor 2. The motor housing 21 accommodates a coil that forms a rotating magnetic field based on an alternating current (for example, three-phase alternating current) and a rotor that is rotated by the rotating magnetic field. The axial direction of the rotation output axis 24 arranged on the rotor is substantially perpendicular, and the rotation output axis 24 extends below the lower housing 22. The drive motor 2 applied to the outboard motor 1 has a substantially circular shape in a plan view in the axial direction of the rotation output axis 24 and has a substantially flat shape, in which a radial dimension (horizontal dimension here) based on the rotation output axis 24 is greater than an axial dimension (vertical dimension). Torque during low revolution in a motor with a large radial dimension is greater than that in a motor without a large radial dimension. Therefore, if the motor with the configuration is applied to the outboard motor 1, great driving force is obtained at, for example, the start of the ship 9. For the convenience of the description, "a plan view in the axial direction of the rotation output axis 24 of the drive motor 2" will be written as "a plan view from the top side" or "a plan view from the bottom side".

The inverter 3 converts the direct current supplied from the control/power supply unit 12 to an alternating current and supplies the alternating current to the drive motor 2. The inverter 3 is arranged above and apart from the drive motor 2 through mounting bosses 701, 702, 703, and 704 mounted on the lower housing 22 of the drive motor 2. In other words, the inverter 3 and the drive motor 2 are stacked and arranged apart from each other in the axial direction (vertical direction) of the rotation output axis 24 of the drive motor 2. A dimension in a left-right direction of the inverter 3 is smaller than an outline (contour) of the drive motor 2 in a plan view from the top side. For example, the inverter 3 has a substantially rectangular shape, in which a narrow-side dimension is smaller than an outside diameter of the drive motor 2 in a plan view from the top side. The inverter 3 is arranged so that a longitudinal direction faces a front-rear direction. Left, right, and front ends of the inverter 3 fall within the outline of the drive motor 2 in a plan view from the top side. However, a rear end section projects to the rear side of a rear end of the main body (substantially circular section excluding partial protrusions) of the drive motor 2. In this way, part of the inverter 3 (specifically, sections other than the rear end section) falls within the outline of the drive motor 2 in a plan view from the top side. A steering handle 5 is installed on the front side of the lower housing 22 of the drive motor 2 (described later). In other words, the inverter 3 falls within the outline of the drive motor 2 in a plan view from the top side, except for the end section opposite the side where the steering handle 5 is installed.

A junction box 38 as a connection section for electrically connecting the connection cable 710 and the inverter 3 are arranged on the left side of the inverter 3 and on the top side of the drive motor 2 (for example, see FIG. 2). The connection cable 710 passes through a bottom left side of the drive motor 2 and goes around from a rear left side to be drawn into the junction box 38. The direct current supplied from the control/power supply unit 12 is supplied to the inverter 3 through the connection cable 710 and the junction box 38. As described, the dimension in the left-right direction of the inverter 3 is smaller than the outside diameter of the drive motor 2. Therefore, in a configuration including the junction box 38 on the left side of the inverter 3, all or most of the junction box 38 falls within the outline of the drive motor 2 in a plan view from the top side. As a result, enlargement of the outboard motor main body 11 can be prevented or suppressed. Particularly, an increase in the dimension in the left-right direction of the outboard motor main body 11 can be prevented or suppressed.

The drive unit 4 converts rotational force output by the drive motor 2 to power for driving the ship 9. The drive unit 4 includes a drive shaft 41, a drive shaft housing 42, a swivel bracket 601, a gear case 43, and the drive propeller 45. The drive unit 4 is arranged on the bottom side of the drive motor 2. The drive shaft 41 is a shaft for transmitting the rotational force of the drive motor 2 to the drive propeller 45. The drive shaft 41 is arranged concentrically with the rotation output axis 24 of the drive motor 2, and the axial direction faces substantially the perpendicular direction. The top end section of the drive shaft 41 is combined with the rotation output axis 24 of the drive motor 2, and the drive shaft 41 rotates integrally with the rotation output axis 24 of the drive motor 2. The drive shaft housing 42 is a member that covers the drive shaft 41. The top end section of the drive shaft housing 42 is combined with the lower housing 22 of the drive motor 2. A section on the top side of a middle section in the vertical direction of the drive shaft housing 42 is combined with the swivel bracket 601, and the section can be rotated (or swung) in the horizontal direction. Therefore, the drive motor 2, the inverter 3, the drive unit 4, and the steering handle 5 can be integrally rotated (or swung) in the horizontal direction relative to the swivel bracket 601. The rotation center (or swing center) serves as a rotation center of steering of the outboard motor 1. The center of steering and the center of the rotation output axis 24 and the drive shaft 41 of the drive motor 2 match. In the drawings, the center of the rotation output axis 24 and the drive shaft 41 of the drive motor 2 that is the rotation center of steering of the outboard motor main body 11 is indicated by a center line $C_V$. The gear case 43 is arranged on the bottom side of the drive shaft housing 42. The gear case 43 accommodates gears and the like for converting the direction of rotation of the rotational force output by the drive motor 2. Specifically, the gear case 43 accommodates a bottom end section of the drive shaft 41, a front section of a propeller shaft 433, a first bevel gear 431, and a second bevel gear 432. The first bevel gear 431 is installed on the bottom end section of the drive shaft 41, and the first bevel gear 431 rotates integrally with the drive shaft 41. The propeller shaft 433 is rotatably supported by the gear case 43, and the axis line faces the front-rear direction. The second bevel gear 432 that meshes with the first bevel gear 431 is arranged on the front section of the propeller shaft 433, and the drive propeller 45 is arranged on the rear section. Additionally, a cavitation plate (not shown) that prevents the drive propeller 45 from taking in the air may be arranged on the bottom section of the drive shaft housing 42.

According to the configuration, the rotational force generated by the drive motor 2 is transmitted to the drive propeller 45 through the drive shaft 41, the first bevel gear 431, the second bevel gear 432, and the propeller shaft 433, and the drive propeller 45 is rotated. As described, the drive motor 2 can output rotational force with high torque even at low speed, and a decelerator is not necessary. Therefore, the rotation output axis 24 and the drive shaft 41 of the drive motor 2 are directly combined without the decelerator. As a result, the drive unit 4 can be downsized and lightened, and the configuration can be simplified. The number of gears can be reduced, and the noise generated by the gears can be reduced. The switch between the positive rotation and the reverse rotation of the drive propeller 45 (switch between forward and rearward of the ship 9) is performed by switching the direction of the rotation of the rotation output axis 24 of the drive motor 2. Therefore, reversing gear as in an outboard motor with an internal combustion engine is not necessary. Since the drive motor 2 can output rotational force with high torque, the reduction ratio from the first bevel gear 431 to the second bevel gear 432 can be reduced. Therefore, the size of the second bevel gear 432 can be reduced. As a result, the gear case 43 can be downsized and lightened, and the configuration can be simplified. Particularly, downsizing of the gear case 43 can reduce the resistance of the gear case 43 in the water during navigation.

The installation unit 602 is a section for installing the outboard motor main body 11 on the ship 9 and is arranged on the front side of the swivel bracket 601. The installation unit 602 includes a clamp bracket 603. The clamp bracket 603 can be fastened and fixed to the Trans Am board 91 (stern) of the ship 9 to install the outboard motor main body 11 on the ship 9. Therefore, when the clamp bracket 603 is mounted on the Trans Am board 91 of the ship 9, the steering handle 5 can be operated to rotate the outboard motor main body 11 in substantially the horizontal direction to steer the ship 9. The clamp bracket 603 is connected to the front side of the swivel bracket 601 through a tilt pin 604 constructed in the left-right direction. The clamp bracket 603 and the swivel bracket 601 can be relatively rotated around the tilt pin 604. Therefore, when the clamp bracket 603 is fixed to the Trans Am board 91 of the ship 9, the outboard motor main body 11 can be rotated around the tilt pin 604 to perform a tilt-up operation of pulling out the drive unit 4 from the water. The drive motor 2 and the inverter 3 heavy in weight are positioned above the tilt pin 604 (particularly, see FIG. 2). According to the configuration, amounts of upward movement of the drive motor 2 and the inverter 3 are reduced in the tilt-up operation. Therefore, the tilt-up operation is facilitated.

The steering handle 5 is a handle used by a ship operator P for a steering operation of the outboard motor 1. The steering handle 5 is arranged to extend forward from the drive motor 2. A base end section (rear end section) of the steering handle 5 is connected to a handle bracket 56, and the base end section can be rotated (or swung) in the vertical direction. The handle bracket 56 is fixed to a boss 58. The boss 58 is a structure that is fixed to a surface on the bottom side of the front end section of the lower housing 22 of the drive motor 2 and that is arranged to project forward from the drive motor 2. The vertical positions of the boss 58, the steering handle 5, and the handle bracket 56 are substantially equal to the vertical position of the surface on the bottom side of the lower housing 22. The center of the boss 58 and the steering handle 5 in the left-right direction is at the same position as the center of the drive motor 2 in the left-right direction. When the ship operator P rotates the steering handle in substantially the horizontal direction, the drive motor 2 and the drive unit 4 rotate in substantially the horizontal direction integrally with the steering handle 5. Therefore, the relative angle between the axial direction of the drive propeller 45 and the ship 9 is changed, and the travelling direction of the ship 9 is changed. The steering handle 5 can be folded toward the drive motor 2 by rotating the tip section upward. Details of the assembly of the steering handle 5 will be described later.

The steering handle 5 includes a main switch 51, an emergency switch 52, a shift switch 53, a throttle grip 54, and a display unit 57. The main switch 51 is a switch for starting and stopping the outboard motor 1. The emergency switch 52 is a switch for emergency stop of the outboard motor 1. The throttle grip 54 is a device for adjusting the rotation speed of the drive motor 2. The throttle grip 54 is arranged on the front end section of the steering handle 5, and the throttle grip 54 can be twisted. A throttle sensor 111 (described later) detects an amount of twist of the throttle grip 54. The number of rotations of the drive motor 2 is set according to the amount of twist of the throttle grip 54. The shift switch 53 is a switch for switching the rotation direction of the drive motor 2. The shift switch 53 detects the direction of the twist of the throttle grip 54 and switches the rotation direction of the drive motor 2 according to the direction of the twist. Therefore, the ship operator P can operate the throttle grip 54 to adjust the rotation direction and the number of rotations of the drive motor 2, i.e. the navigation direction and the navigation speed of the ship 9. The display unit 57 can display information related to the outboard motor 1 and the ship 9 on which the outboard motor 1 is mounted, such as the remaining battery of the control/power supply unit 12, the rotation speed of the drive motor 2, and the travel speed of the ship 9. The configuration of the display unit 57 is not particularly limited. The display unit 57 can have any configuration that can display predetermined characters and numbers, and for example, a light-emitting dial including LED or a liquid crystal display apparatus can be applied. A control unit 121 (described later) controls the information displayed by the display unit 57.

The outboard motor main body 11 includes a carrying handle 605 used for transport and the like. The carrying handle 605 is fixed to a rear end section of the bottom surface of the lower housing 22 of the drive motor 2, and the carrying handle 605 protrudes to the rear side from the drive motor 2. Details of the configuration of the carrying handle 605 will be described later.

The outboard motor main body 11 and the control/power supply unit 12 are electrically connected by the connection cable 710. The connection cable 710 as a whole is flexible. Therefore, when a tilt-up operation or a steering operation of the outboard motor main body 11 is performed while the connection cable 710 is connected to the outboard motor main body 11 and the control/power supply unit 12, the connection cable 710 follows the displacement of the outboard motor main body 11 and is easily bent. As a result, the connection cable 710 does not disturb the tilt-up operation or the steering operation, and supply of power or transfer of a signal is not affected even if the connection cable 710 is bent.

A cable holder 25 accommodates the neighborhood of the end section closer to the outboard motor main body 11 of the connection cable 710. The cable holder 25 is fixed to the outboard motor main body 11. The cable holder 25 accommodates the connection cable 710, and the connection cable 710 is held and positioned relative to the outboard motor main body 11. A configuration of routing of the cable holder 25 and the connection cable 710 to the outboard motor main body 11 will be described later. Meanwhile, a coupler 718 is arranged on the end section closer to the control/power supply unit 12 of the connection cable 710. The connection cable 710 and the control/power supply unit 12 are combined by the coupler 718 arranged on the connection cable 710 and a coupler 126 arranged on the control/power supply unit 12, and the connection cable 710 and the control/power supply unit 12 can be freely separated. The configuration facilitates combining and separation of the connection cable 710 and the control/power supply unit 12. Therefore, the handleability of the outboard motor 1 can be improved.

Figure 3:
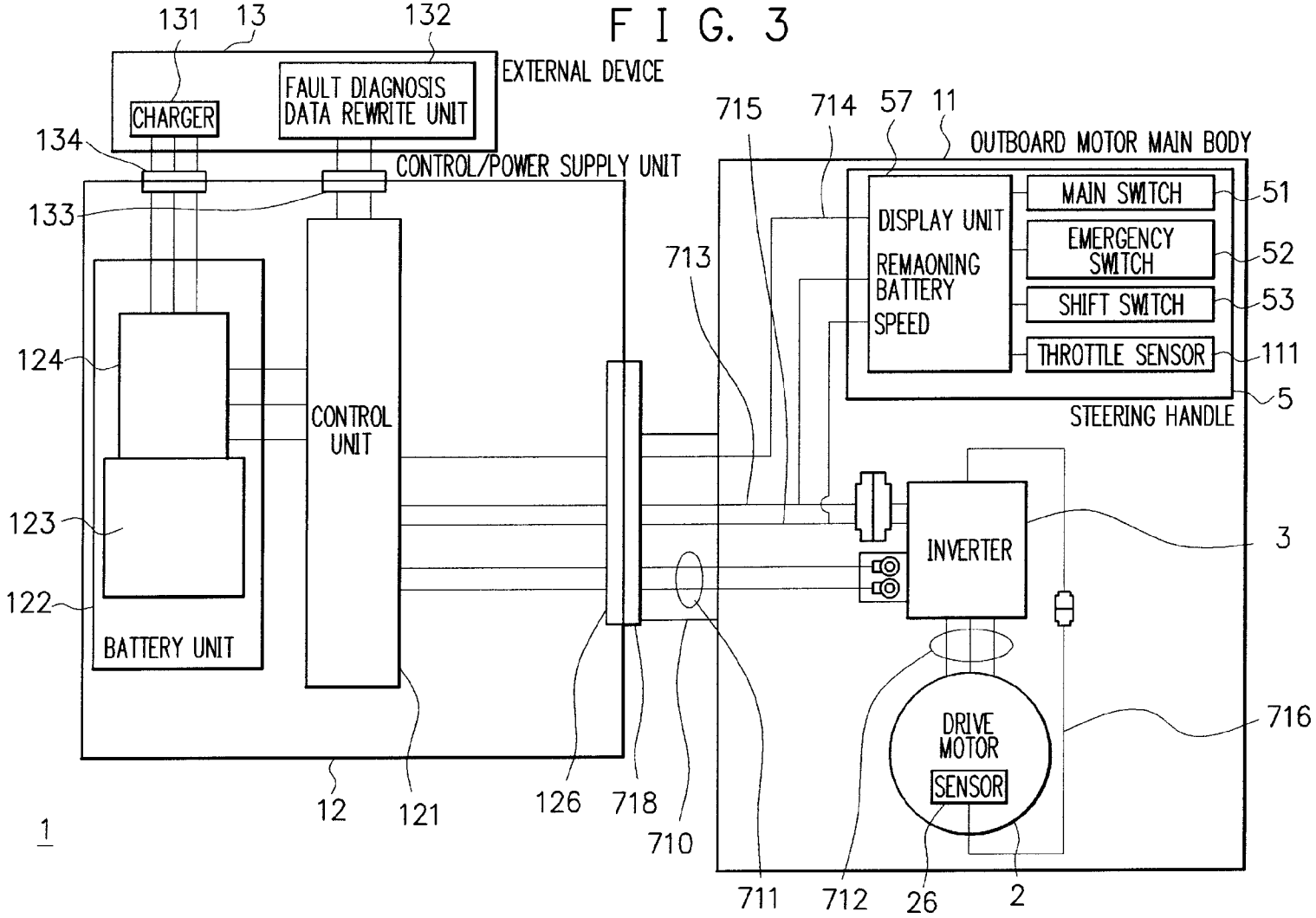
FIG. 3 is a block diagram schematically showing a configuration of the electric outboard motor according to the embodiment of the present invention.

A configuration of the system of the outboard motor 1 will be described with reference to FIG. 3. FIG. 3 is a block diagram schematically showing a configuration of the system of the outboard motor 1. As shown in FIG. 3, the outboard motor 1 includes the outboard motor main body 11 and the control/power supply unit 12. The outboard motor main body 11 and the control/power supply unit 12 are electrically connected by the connection cable 710. A predetermined external device 13 can be removably and electrically connected to the control/power supply unit 12 through couplers 133 and 134.

The outboard motor main body 11 includes the inverter 3, the drive motor 2, and the steering handle 5. A sensor 26 is arranged on the drive motor 2. The display unit 57, the main switch 51, the emergency switch 52, the shift switch 53, and the throttle sensor 111 are arranged on the steering handle 5. The control/power supply unit 12 includes the control unit 121 that controls the outboard motor 1 and a battery unit 122 as a power supply of the outboard motor 1. The control/power supply unit 12 further includes the coupler 126 that can connect the connection cable 710 and the couplers 133 and 134 that can connect the external device 13.

The connection cable 710 includes a power line 711 that supplies driving power of the drive motor 2 to the inverter 3, a power line 713 that supplies driving power of devices other than the drive motor 2, a signal line 715 that connects the control/power supply unit 12 and the outboard motor main body 11 to allow transfer of signals, and a signal line 714 that connects the main switch 51 and the control/power supply unit 12 to allow transfer of signals. For the convenience of the description, the power lines and the signal lines will be called as follows. The power line 711 that supplies the driving power of the drive motor 2 to the inverter 3 will be called a "first main power line 711". The power line 713 that supplies driving power of the devices other than the drive motor 2 will be called a "sub power line 713". The signal line 715 that connects the control/power supply unit 12 and the outboard motor main body 11 to allow transfer of signals will be called a "first signal line 715". The signal line 714 that connects the main switch 51 and the control/power supply unit 12 to allow transfer of signals will be called a "main switch line 714". The first main power line 711, the sub power line 713, the first signal line 715, and the main switch line 714 are coated by a waterproof, flexible coating material such as a resin composition.

The inverter 3 of the outboard motor main body 11 is connected to the control unit 121 of the control/power supply unit 12 through the first signal line 715 to allow transfer of signals. The sensor 26 can detect a state of the drive motor 2, such as phase, rotation speed, and temperature. The sensor 26 and the inverter 3 are connected through another signal line 716 to allow transfer of signals. For the convenience of the description, the other signal line 716 will be called a "second signal line 716". The second signal line 716 branches from the first signal line 715 through the inverter 3. The state of the drive motor 2 detected by the sensor 26 is transmitted to the control unit 121 of the control/power supply unit 12 through the second signal line 716, the inverter 3, and the first signal line 715 included in the connection cable 710. The main switch 51 is connected to the control unit 121 of the control/power supply unit 12 through the main switch line 714 to allow transfer of signals. The control unit 121 of the control/power supply unit 12 detects the state (ON or OFF) of the main switch 51 through the main switch line 714. The emergency switch 52, the shift switch 53, and the throttle sensor 111 are electrically connected to the display unit 57 to allow transfer of signals. The display unit 57 is electrically connected to the control unit 121 of the control/power supply unit 12 through the first signal line 715 included in the connection cable 710 to allow transfer of signals. Therefore, the information indicating whether the emergency switch 52 is operated, the state of the shift switch 53, and the amount of twist of the throttle grip 54 detected by the throttle sensor 111 are transmitted to the control unit 121 of the control/power supply unit 12 through the display unit 57 and the first signal line 715.

The control/power supply unit 12 includes: the coupler 126 that can connect the control unit 121, the battery unit 122, and the connection cable 710; and the couplers 133 and 134 that can connect the external device 13.

The control unit 121 includes: a memory that can store data related to setting of software (computer program) and the outboard motor 1; and a processor that can read and execute the setting of the software and the outboard motor 1 from the memory. The control unit 121 executes the software based on the setting of the outboard motor 1 to control the outboard motor 1.

The battery unit 122 is a section serving as a power supply of the outboard motor 1. The battery unit 122 includes one or a plurality of packaged battery packs 123 (batteries) and a battery pack mounting unit 124 that can attach and remove a plurality of (for example, two) battery packs 123 at the same time. One or a plurality of battery packs 123 are mounted on the battery pack mounting unit 124. The battery pack 123 is a DC power supply, and for example, a set of cells of lithium ion batteries is applied. The control unit 121 and the battery unit 122 are connected to allow transfer of signals and to allow supply of power from the battery unit 122 to the control unit 121.

The control unit 121 can control the battery unit 122 to supply a direct current for driving the drive motor 2 to the inverter 3 of the outboard motor main body 11 through the first main power line 711 of the connection cable 710. The control unit 121 can also supply a direct current for driving the inverter 3 and other components of the outboard motor main body 11 through the sub power line 713. The control unit 121 can further supply a direct current to the predetermined external device 13 connected to the control/power supply unit 12.

The ship operator P and the like can remove the battery packs 123 from the battery pack mounting unit 124 to transport the battery packs 123. The battery packs 123 can be charged by a charger 131 of the external device 13 for repeated use. Once the battery packs 123 are installed on the battery pack mounting unit 124, the battery packs 123 can supply power for driving the control unit 121, the drive motor 2 of the outboard motor main body 11, and other components. If the battery packs 123 can be attached and removed from the battery pack mounting unit 124, the battery packs 123 can be removed from the outboard motor 1 when the outboard motor 1 is not used. This facilitates maintenance and storage of the battery packs 123. The battery packs 123 with little remaining batteries can be removed, and charged battery packs 123 can be mounted. This allows efficient use of the battery packs 123. For example, charged battery packs 123 can be always mounted and used to improve the utilization rate of the ship 9 on which the outboard motor 1 is mounted. The size of the battery packs 123 can be changed according to the application of the ship 9. The battery packs 123 can be mounted on at least one of the plurality of battery pack mounting unit 124. Therefore, the number of mounted battery packs 123 can be changed according to the application of the ship 9. The power source can be multiplexed by mounting two or more battery packs 123 on a plurality of battery pack mounting unit 124.

A Controller Area Network (hereinafter, "CAN") or an Electric Vehicle Controller (EVC) is applied for the connection between the display unit 57 as well as the inverter 3 of the outboard motor main body 11 and the control unit 121 of the control/power supply unit 12. For example, a CAN controller is arranged on the control unit 121 when the CAN is applied, and the first signal line 715 serves as a CAN bus. The inverter 3 converts a signal transmitted from the sensor 26 to a signal compatible with the CAN or the Electric Vehicle Controller (signal that can be transmitted and received by the CAN bus or the EVC). Similarly, the display unit 57 converts signals transmitted from the emergency switch 52, the shift switch 53, and the throttle sensor 111 to signals compatible with the CAN or the Electric Vehicle Controller. For example, circuits that convert signals transmitted from the outside to signals compatible with the CAN or the Electric Vehicle Controller are arranged on the inverter 3 and the display unit 57. According to the configuration, the state of the drive motor 2 detected by the sensor 26 can be transmitted to the control unit 121 through the inverter 3 and the first signal line 715. Similarly, the states of the emergency switch 52, the shift switch 53, and the throttle sensor 111 can be transmitted to the control unit 121 through the display unit 57 and the first signal line 715. The CAN and the Electric Vehicle Controller are standardized known communication techniques, and the techniques will not be described.

The predetermined external device 13 includes the charger 131 and a fault diagnosis/data rewrite unit 132. The charger 131 of the external device 13 can be electrically connected to the battery unit 122 of the control/power supply unit 12 to charge battery packs 123 mounted on the battery unit 122 of the control/power supply unit 12. The fault diagnosis/data rewrite unit 132 of the external device 13 can be electrically connected to the control unit 121 of the control/power supply unit 12 to allow transfer of signals to read out the state of the outboard motor 1 to determine whether the state is normal. The fault diagnosis/data rewrite unit 132 of the external device 13 can further rewrite the software or setting stored in the memory of the control unit 121.

An overall operation of the outboard motor 1 is as follows. When the control unit 121 detects that the main switch 51 is turned on, the control unit 121 reads and executes the software for controlling the outboard motor 1 and prepares for the operation of the outboard motor 1. When the shift switch 53 is operated while the main switch 51 is ON, information of the operation is transmitted to the control unit 121 through the first signal line 715. The control unit 121 switches the rotation direction of the drive motor 2 according to the state of the shift switch 53. The control unit 121 further controls the inverter 3 based on the amount of twist of the throttle grip 54 detected by the throttle sensor 111 and based on the state of the drive motor 2 detected by the sensor 26 to control the alternating current supplied to the drive motor 2. Based on the control by the control unit 121, the display unit 57 displays information related to the outboard motor 1 and the ship 9 on which the outboard motor 1 is mounted, such as the remaining battery of the battery unit 122, the navigation speed of the ship 9 on which the outboard motor 1 is mounted, and the state of the drive motor 2 detected by the sensor 26. When the control unit 121 detects that the main switch 51 is turned off, the control unit 121 stops supplying power to the drive motor 2 and stops the operation of the outboard motor 1. When the control unit 121 detects an operation of the emergency switch 52 during operation of the outboard motor 1, the control unit 121 stops supplying power to the drive motor 2 and stops the rotation of the drive motor 2.

Figure 4:
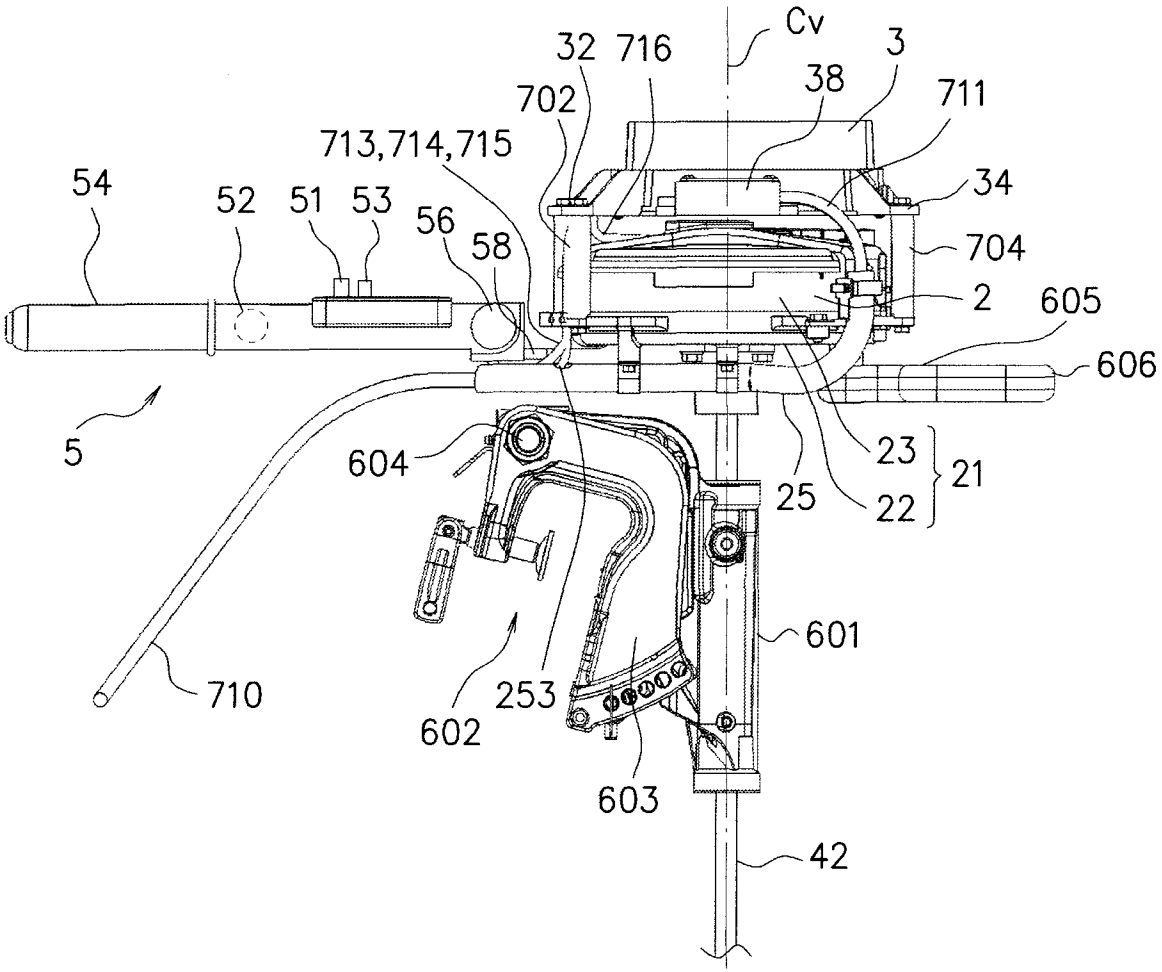
FIG. 4 is a side view schematically showing a configuration of a top section of an outboard motor main body and is a view seen from a left side.
Figure 5:
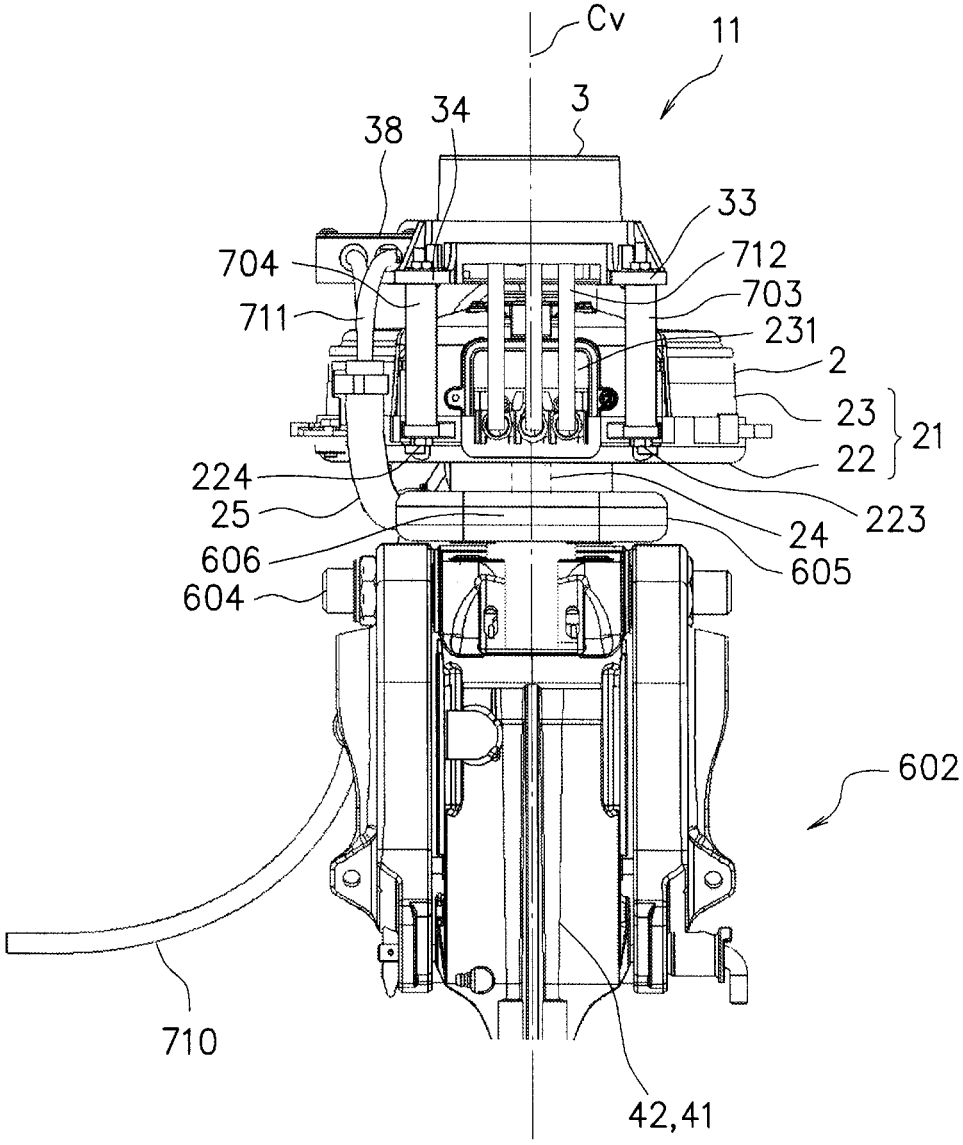
FIG. 5 is a rear view schematically showing the configuration of the top section of the outboard motor main body.
Figure 6:
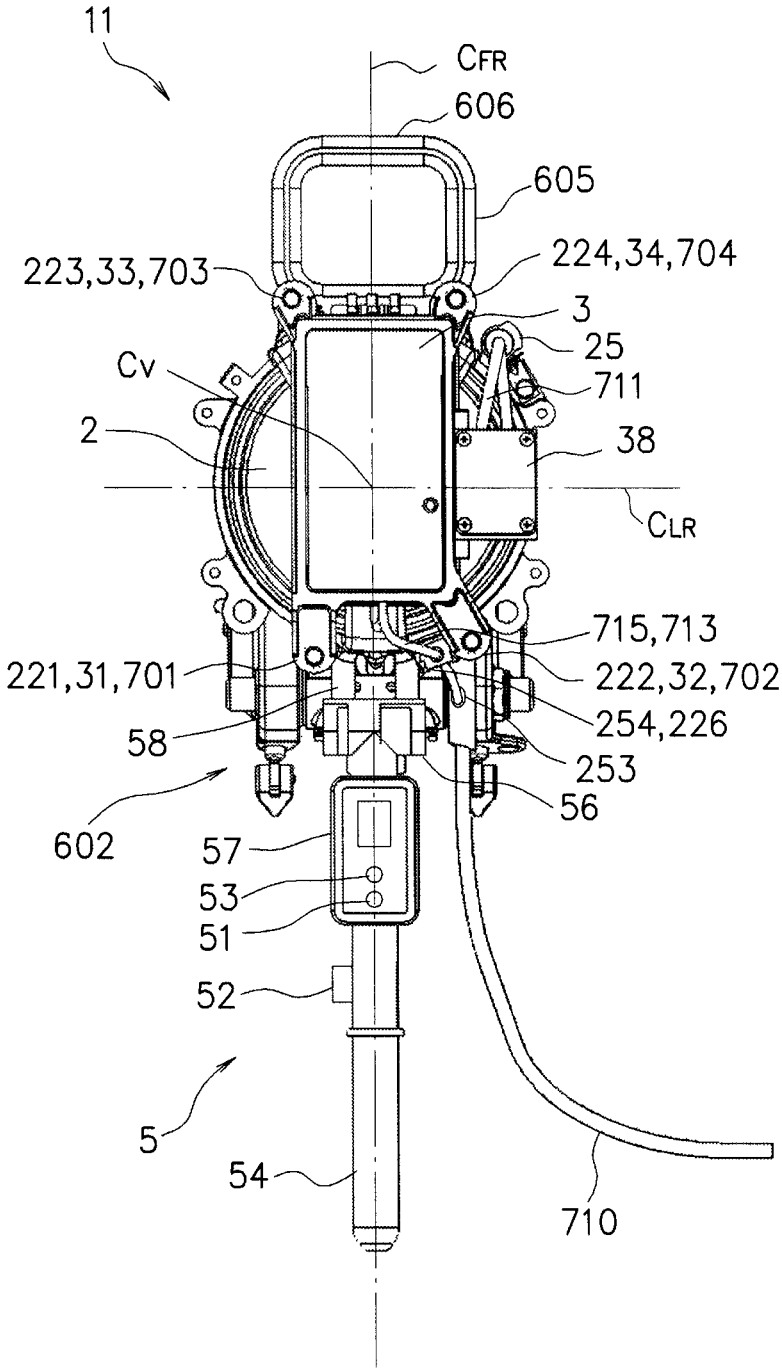
FIG. 6 is a plan view schematically showing the configuration of the top section of the outboard motor main body and is a view seen from a top side.
Figure 7:
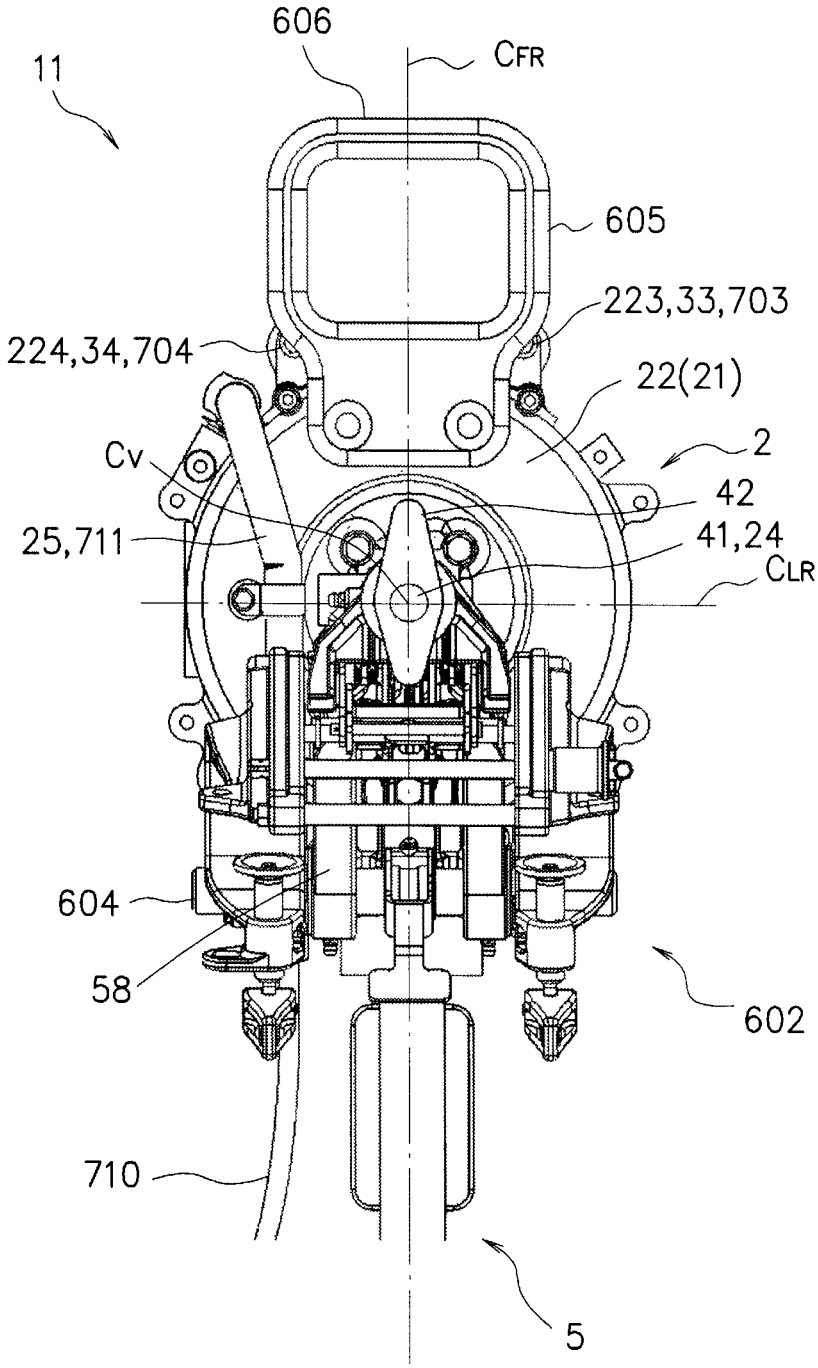
FIG. 7 is a plan view schematically showing the configuration of the top section of the outboard motor main body and is a view seen from a bottom side.
Figure 8:
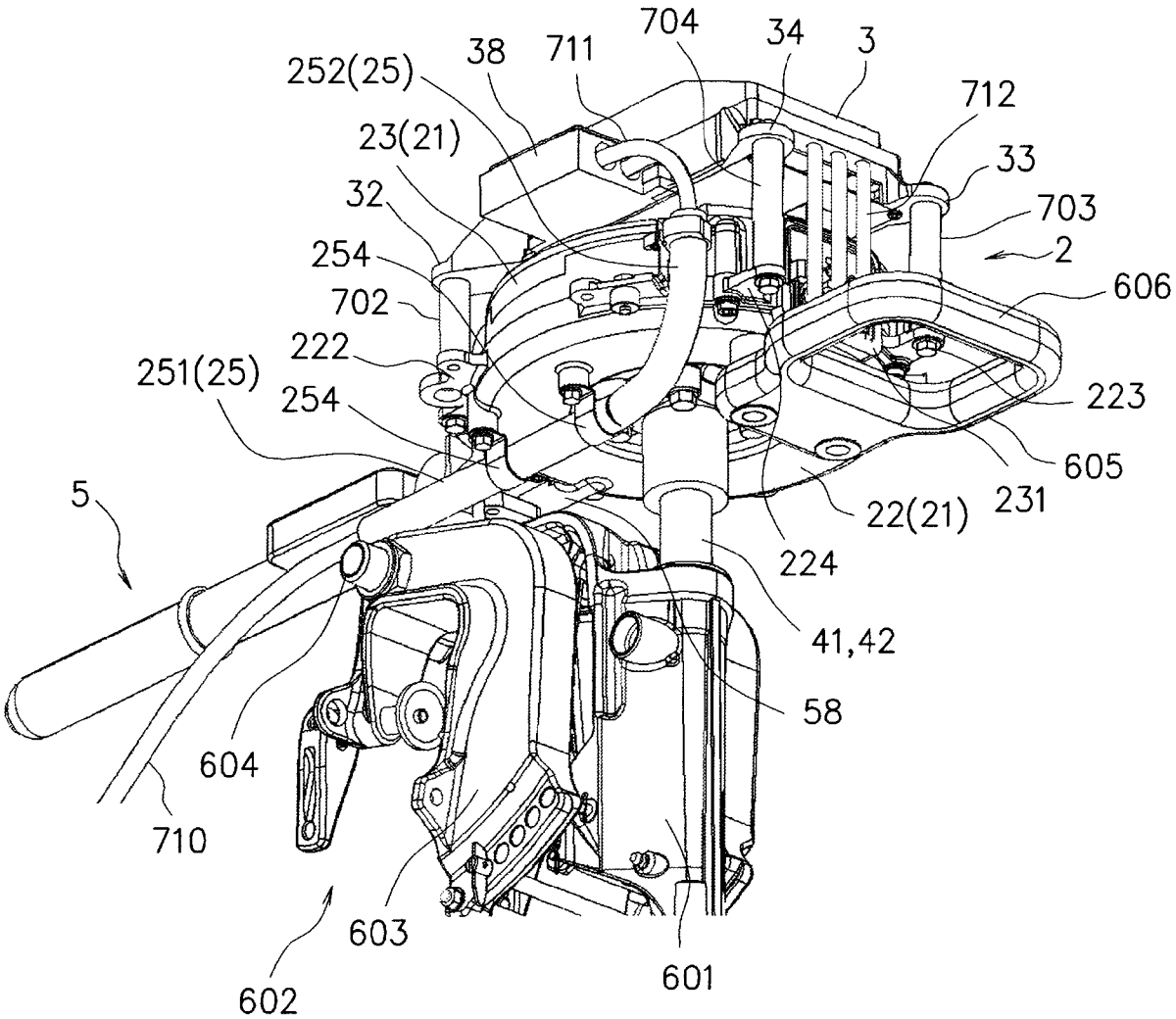
FIG. 8 is a perspective view schematically showing the configuration of the top section of the outboard motor main body and is a view seen from bottom left oblique rear.
Figure 9:
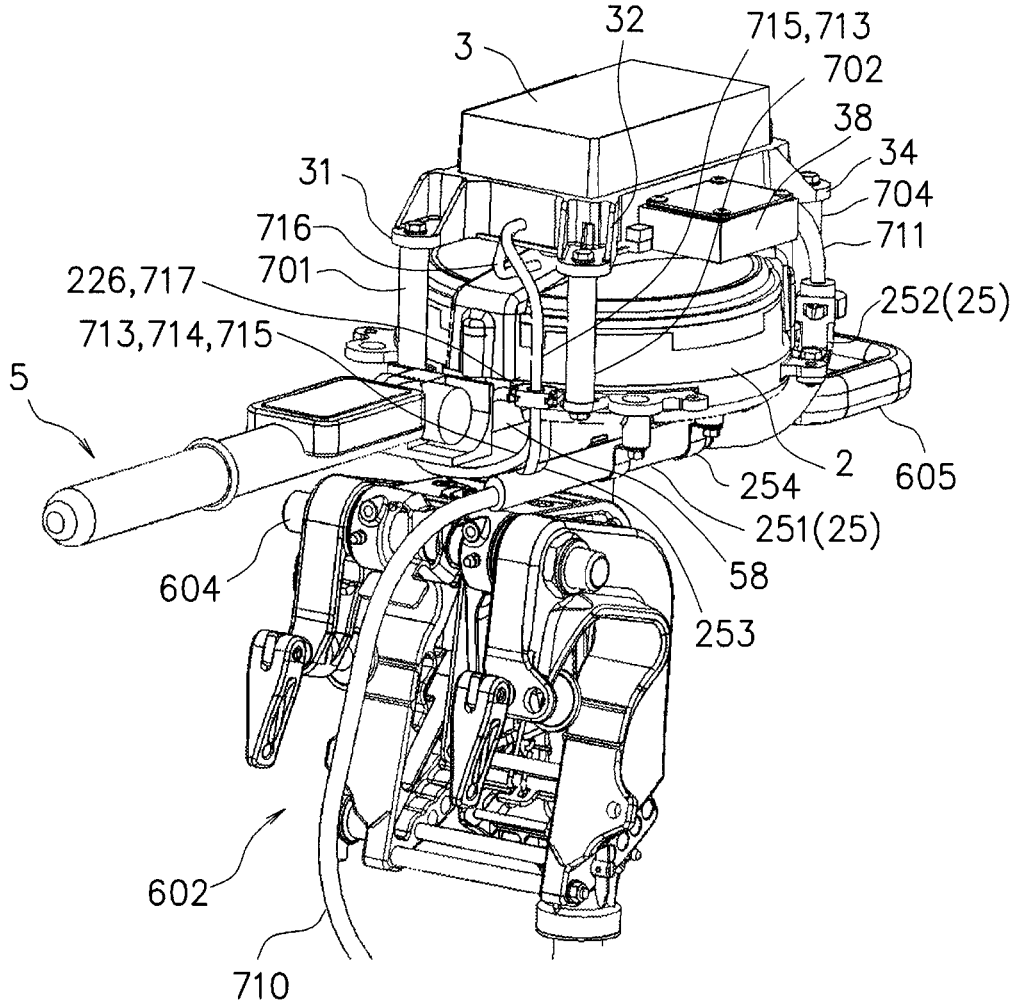
FIG. 9 is a perspective view schematically showing the configuration of the top section of the outboard motor main body and is a view seen from top left oblique front.
Figure 10:
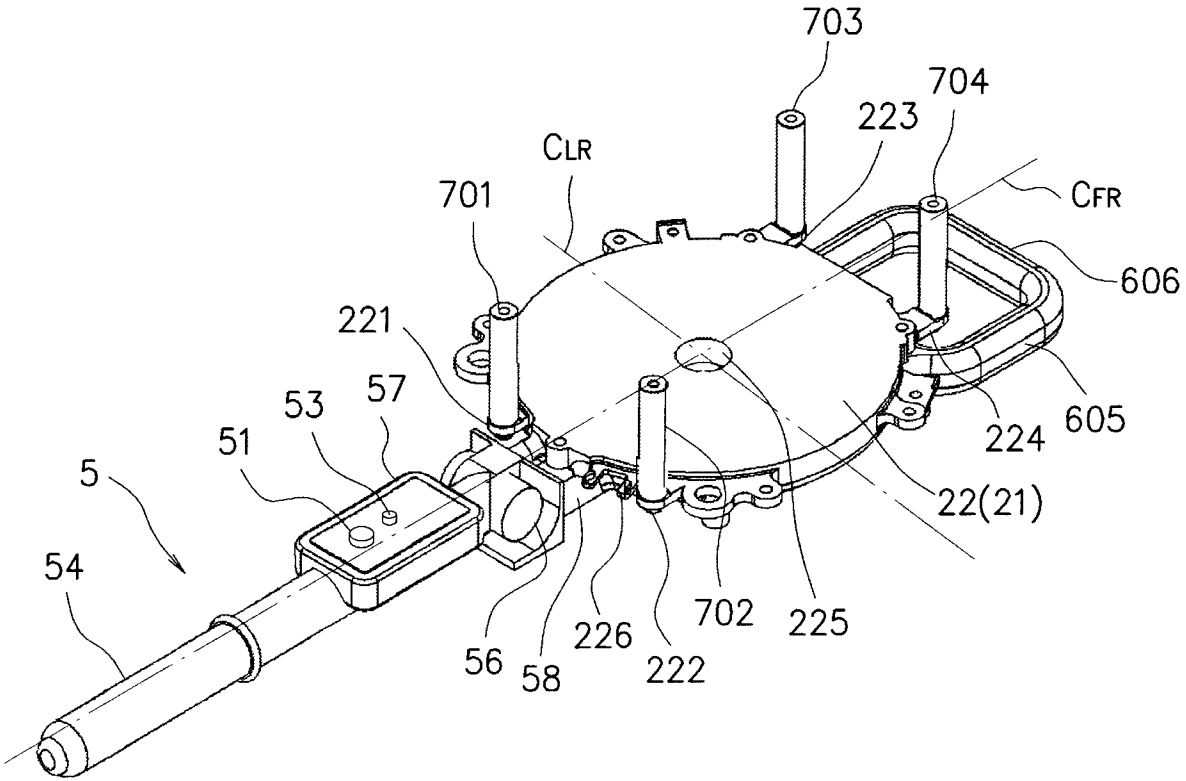
FIG. 10 is an external perspective view schematically showing configurations of a lower housing and a mounting boss of a drive motor and is a view seen from top left oblique front.
Figure 11:
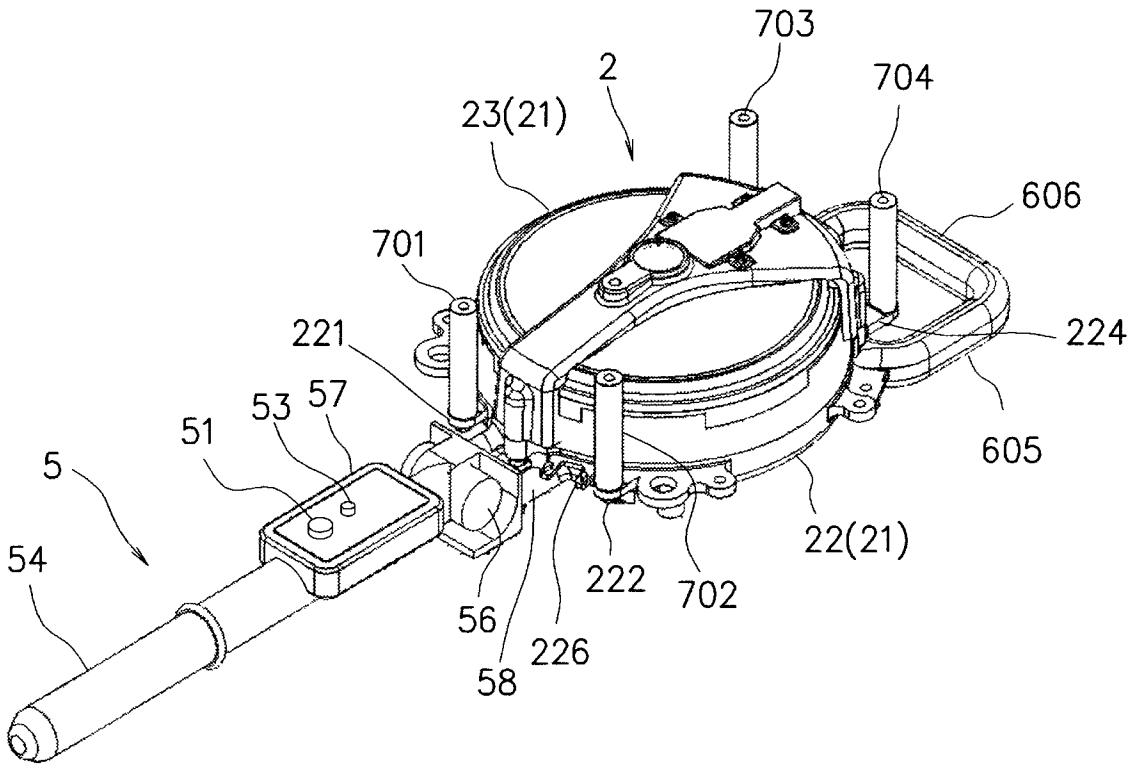
FIG. 11 is an external perspective view schematically showing a configuration of the drive motor and is a view seen from top left oblique front.
Figure 12A:
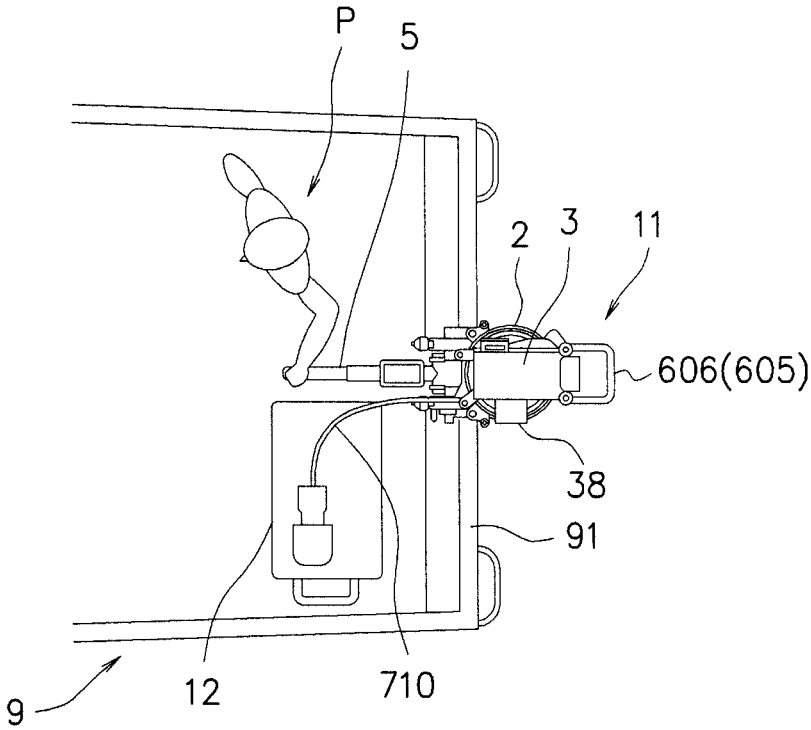
FIG. 12A is a plan view schematically showing a state in which a ship operator P operates the outboard motor main body to drive a ship straight.
Figure 12B:
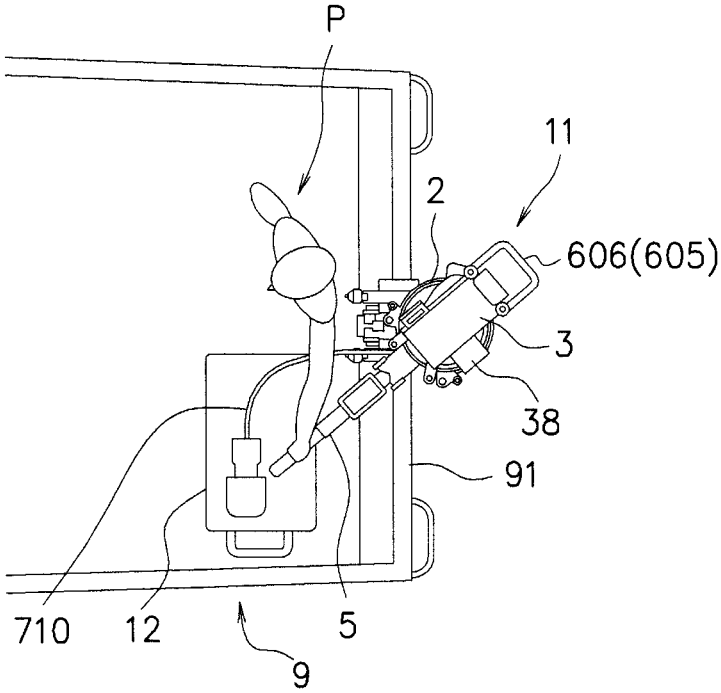
FIG. 12B is a plan view schematically showing a state in which the ship operator operates the outboard motor main body to steer the ship to turn right.

An assembly of the drive motor 2 and the inverter 3, an assembly of the steering handle 5, a configuration of routing of the connection cable 710 to the outboard motor main body 11, and a configuration of electrical connection between the drive motor 2 and the inverter 3 will be described with reference to FIGS. 4 to 12. FIG. 4 is a side view schematically showing the configuration of the top section of the outboard motor main body 11 and is a view seen from the left side. FIG. 5 is a rear view schematically showing the configuration of the top section of the outboard motor main body 11. FIG. 6 is a plan view schematically showing the configuration of the top section of the outboard motor main body 11 and is a view seen from the top side. FIG. 7 is a plan view schematically showing the configuration of the top section of the outboard motor main body 11 and is a view seen from the bottom side. FIG. 8 is a perspective view schematically showing the configuration of the top section of the outboard motor main body 11 and is a view seen from bottom left oblique rear. FIG. 9 is a perspective view schematically showing the configuration of the top section of the outboard motor main body 11 and is a view seen from top left oblique front. FIG. 10 is an external perspective view schematically showing the configurations of the lower housing 22 and the mounting bosses 701, 702, 703, and 704 of the drive motor 2 and is a view seen from top left oblique front. FIG. 11 is an external perspective view schematically showing the configuration of the drive motor 2 and is a view seen from top left oblique front. FIG. 12A is a plan view schematically showing a state in which the ship operator P operates the outboard motor main body 11 to drive the ship 9 straight. FIG. 12B is a plan view schematically showing a state in which the ship operator P operates the outboard motor main body 11 to steer the ship 9 to turn right.

The assemblies of the drive motor 2 and the inverter 3 will be first described. As shown in FIGS. 4 to 9, the inverter 3 is arranged above the drive motor 2 and apart from the drive motor 2. In other words, the inverter 3 and the drive motor 2 are stacked and arranged apart from each other in the axial direction (vertical direction) of the rotation output axis 24 of the drive motor 2 (for example, see FIGS. 4, 5, 8, and 9).

For example, as shown in FIG. 6, the drive motor 2 is substantially circular in a plan view from the top side, and the inverter 3 is substantially rectangular. The inverter 3 is arranged so that the longitudinal direction faces the front-rear direction. The drive motor 2 and the inverter 3 are arranged so that the centers in the left-right direction (shown by a center line $C_{FR}$ in FIG. 6) match (or substantially match). The dimension in the left-right direction (width direction dimension, narrow-side dimension) of the inverter 3 is smaller than the outside diameter of the drive motor 2. Therefore, left and right end sections (width direction end sections) of the inverter 3 do not stick out in the left-right direction from the outline (contour) of the drive motor 2 in a plan view from the top side. As for the front-rear direction, the center in the front-rear direction of the inverter 3 is arranged at a position shifted to the rear side relative to the center in the front-rear direction of the drive motor 2. Although the front end section of the inverter 3 does not stick out from the outline of the drive motor 2 in a plan view from the top side, the rear end section projects to the rear side from the outline of the drive motor 2. For example, when the front-rear dimension of the inverter 3 is greater than the outside diameter of the drive motor 2, the surface on the front side of the inverter 3 is positioned behind the surface on the front side of the drive motor 2. In this way, the inverter 3 is arranged to overlap the top side of the drive motor 2, except for the rear end section. The center (rotation center of steering) (center line $C_V$ in FIG. 6 and the like) of the rotation output axis 24 and the drive shaft 41 of the drive motor 2 is positioned inside of the outline of the inverter 3 in a plan view from the top side. Particularly, it is preferable if the position of the center of gravity of the inverter 3 and the position of the center of the rotation output axis 24 and the drive shaft 41 of the drive motor 2 are as close as possible in a plan view from the top side, and it is more preferable if the positions match. The inverter 3 and the drive motor 2 are electrically connected at the rear end section (described later).

In the configuration in which the inverter 3 and the drive motor 2 are stacked and arranged in the vertical direction, the moment of inertia of the inverter 3 related to the rotation center of steering is smaller than that in a configuration in which the inverter 3 and the drive motor 2 are aligned in the horizontal direction. According to the configuration, the power required for the steering operation of the outboard motor main body 11 is reduced, and the steering operation can be quickly performed. Therefore, the operability of the outboard motor 1 can be improved. The inverter 3 falls within the outline of the drive motor 2 in a plan view from the top side. Therefore, as shown in FIG. 12, the inverter 3 does not enter the space on the ship 9 even if the outboard motor main body 11 is steered, regardless of the angle of steering of the outboard motor main body 11. Therefore, the space on the ship 9 is not compressed. For example, even if a commodity or the like is placed on the stern, the outboard motor main body 11 can be steered without the inverter 3 touching the commodity or the like. In this way, the space on the ship 9 can be effectively used.

The inverter 3 is installed on the lower housing 22 of the drive motor 2 through the mounting bosses 701, 702, 703, and 704. As shown in FIGS. 9 and 10, the lower housing 22 of the drive motor 2 as a whole has substantially a circular shape in a plan view from the top side. An axis insertion hole 225 for inserting the rotation output axis 24 of the drive motor 2 is formed at the center of the lower housing 22. Brackets 221, 222, 223, and 224 for installing the mounting bosses 701, 702, 703, and 704 are arranged at two sections on the front side and two sections on the rear side of the lower housing 22 (four sections in total). The two brackets 223 and 224 on the rear side extend to the rear side from the periphery of the main body (substantially circular section in a plan view from the top side) of the lower housing 22. The two brackets 223 and 224 on the rear side are symmetrically positioned across the center line $C_{FR}$ in relation to the left-right direction of the lower housing 22 (line extending in the front-rear direction and passing through the center of the axis insertion hole 225). The rear ends of the two brackets 223 and 224 on the rear side are positioned further behind the rear end (surface on the rear side) of the main body of the lower housing 22. The two brackets 221 and 222 on the front side extend to the front side from the periphery of the lower housing 22. The front ends of the two brackets 223 and 224 on the front side are positioned further forward than the front end (surface on the front side) of the main body of the lower housing 22. The two brackets 221 and 222 on the front side are arranged at a predetermined interval in the left-right direction across the center line $C_{FR}$. However, unlike the two brackets 223 and 224 on the rear side, the two brackets 221 and 222 on the front side are arranged at asymmetrical positions. Specifically, the distance between the front-left bracket 222 and the center line $C_{FR}$ is longer than the distance between the front-right bracket 221 and the center line $C_{FR}$. A holding unit 226 that holds the first signal line 715 and the sub power line 713 to positioned states is arranged between the two brackets 221 and 222 on the front side and between the boss 58 as well as the handle bracket 56 and the front-left bracket 222 in a plan view from the top side. Although the configuration of the holding unit 226 is not particularly limited, for example, two claws or protrusions that can sandwich a grommet 717 installed on the first signal line 715 and the sub power line 713 are applied.

Meanwhile, as shown for example in FIG. 6, brackets 31, 32, 33, and 34 for attachment to the mounting bosses 701, 702, 703, and 704 are arranged at four corners of the inverter 3, as in the lower housing 22. The two brackets 33 and 34 on the rear side extend diagonally rearward. The rear ends of the two brackets 33 and 34 on the rear side are positioned further behind the surface on the rear side of the inverter 3. The front-right bracket 31 extends forward. The left-front bracket 32 extends forward and left.

The rod-like mounting bosses 701, 702, 703, and 704 are installed on the brackets 221, 222, 223, and 224 at four sections of the lower housing 22, and the rod-like mounting bosses 701, 702, 703, and 704 rise substantially perpendicularly upward. In other words, the rod-like mounting bosses 701, 702, 703, and 704 rise to the side (upward) opposite the direction (downward) of the extension of the rotation output axis 24 of the drive motor 2. The brackets 31, 32, 33, and 34 at four sections of the inverter 3 are installed on the top ends of the four mounting bosses 701, 702, 703, and 704, respectively. For example, through holes in the vertical direction are formed in the brackets 221, 222, 223, and 224 at four sections of the lower housing 22 and in the brackets 31, 32, 33, and 34 at four corners of the inverter 3. Meanwhile, screw holes are formed at both ends of the four mounting bosses 701, 702, 703, and 704. The mounting bosses 701, 702, 703, and 704 are removably fixed by screws to the brackets 221, 222, 223, and 224 at four sections of the lower housing 22. The brackets 31, 32, 33, and 34 at four corners of the inverter 3 are removably fixed to the top ends of the mounting bosses 701, 702, 703, and 704. The vertical dimension of the mounting bosses 701, 702, 703, and 704 is greater than the vertical dimension of the drive motor 2. The top ends of the mounting bosses 701, 702, 703, and 704 are positioned above the surface on the top side of the upper housing 23 of the drive motor 2. Therefore, the surface on the top side of the drive motor 2 and the surface on the bottom side of the inverter 3 do not touch, and the surfaces are separated at a predetermined interval. The configuration makes it difficult to transmit the heat generated by the drive motor 2 to the inverter 3. This can prevent or suppress the inverter 3 from being influenced by heat generated by the drive motor 2. If the inverter 3 and the drive motor 2 are separated, the surface on the bottom side of the inverter 3 and the surface on the top side of the drive motor 2 are exposed to the open air, and the air can pass between the inverter 3 and the drive motor 2. Therefore, the cooling efficiency of the drive motor 2 and the inverter 3 can be improved. The inverter 3 is installed on the drive motor 2 through the mounting bosses 701, 702, 703, and 704 and is not directly in touch with the motor housing 21. Therefore, the vibration of the drive motor 2 is not easily transmitted to the inverter 3. As a result, the influence of the vibration of the drive motor 2 on the inverter 3 can be reduced. For example, damage of an electric circuit or an electronic circuit of the inverter 3 by the vibration can be prevented or suppressed.

The assembly of the steering handle 5 will be described. The steering handle 5 is a handle for a steering operation in which the ship operator P steers the ship 9. As shown for example in FIGS. 4, 9, 10, and 11, the steering handle 5 is integrally arranged on the lower housing 22 of the drive motor 2 through the boss 58 and the handle bracket 56. The steering handle 5 extends forward from the front side of the outboard motor main body 11 (front end of the drive motor 2). For example, as shown in FIG. 4, the boss 58 is installed on the surface on the bottom side of the front section of the lower housing 22, and the boss 58 protrudes forward. For example, the front end of the boss 58 is positioned on the front side of the front end of the drive motor 2 in a plan view from the top side. The surface on the bottom side of the lower housing 22 of the drive motor 2 is at a position above and apart from the clamp bracket 603. Therefore, the boss 58 linearly protrudes forward from the surface on the bottom side of the lower housing 22 of the drive motor 2. More specifically, the boss 58 does not have to be curved or bent to prevent interference between the boss 58 and the clamp bracket 603. Since the configuration of the boss 58 can be simplified, the weight can be reduced while maintaining the strength. The handle bracket 56 is installed on the front end of the boss 58. The rear end section (base end section) of the steering handle 5 is connected to the handle bracket 56. The steering handle 5 is arranged at substantially the same height as the surface on the bottom side of the lower housing 22 of the drive motor 2 and is arranged at a position higher than the clamp bracket 603. Therefore, the surface on the bottom side of the steering handle 5 and the surface on the bottom side of the lower housing 22 are separated from the surface on the top side of the clamp bracket 603 at a predetermined distance in the vertical direction in a side view from left or right. The connection cable 710 is routed at a position lower than the steering handle 5 and higher than the clamp bracket 603 of the installation unit 602. Therefore, the connection cable 710 does not overlap with the boss 58, the handle bracket 56, and the steering handle 5 in the height direction. A configuration of routing of the connection cable 710 will be described later.

The rear end section of the steering handle 5 and the handle bracket 56 are connected by a mechanism using, for example, a hinge. The steering handle 5 and the handle bracket 56 cannot be relatively rotated in the horizontal direction, but can be relatively rotated in the vertical direction. Therefore, the steering handle 5 can be rotated in the horizontal direction to rotate the outboard motor main body 11 in the horizontal direction around the swivel bracket 601, and the travelling direction of the ship 9 can be changed. The front side (tip side) of the steering handle 5 can be lifted around the hinge to fold the steering handle 5 toward the drive motor 2. The throttle grip 54 is arranged on the front end section of the steering handle 5. The throttle grip 54 can be twisted relative to the steering handle 5. The ship operator P can adjust the amount of twist of the throttle grip 54 to adjust the number of rotations of the drive motor 2. The display unit 57 is further arranged on the steering handle 5.

As shown for example in FIGS. 6, 7, 10, and 11, the center of the rotation output axis 24 and the drive shaft 41 of the drive motor 2 (rotation center of steering, center line $C_V$) and the position in the left-right direction of the steering handle 5 match in a plan view from the top side. Therefore, the center of the rotation output axis 24 and the drive shaft 41 of the drive motor 2 are positioned on an extension line of the axis line of the steering handle 5. According to the configuration, the steering angles of the steering handle 5 can be equalized on the left and right during steering. Therefore, the operability can be improved. According to the configuration, application of an excessive bending moment to the handle bracket 56 and the boss 58 can be prevented in the steering operation.

The configuration of routing of the connection cable 710 to the outboard motor main body 11 will be described. The cable holder 25 that positions and holds the connection cable 710 is arranged on the outboard motor main body 11. The cable holder 25 is a cylindrical member, and the cable holder 25 accommodates the connection cable 710 to hold the connection cable 710 at a predetermined position. The cable holder 25 includes a substantially horizontal section extending in substantially the front-rear direction (the section will be called a "horizontal section") and a section rising upward at the rear section of the horizontal section 251 (the section will be called a "rising section"). As shown for example in FIGS. 4, 7, and 8, the horizontal section 251 is positioned between the lower housing 22 and the installation unit 602 of the drive motor 2 in the vertical direction. In the left-right direction, the horizontal section 251 is positioned on the left side of the rotation output axis 24 and the drive shaft 41 of the drive motor 2 (left side in the forward direction of the ship 9). In a plan view from the top or bottom side, the horizontal section 251 is positioned on the side of the rotation output axis 24 relative to the outline at a section with the maximum dimension in the left-right direction of the lower housing 22 of the drive motor 2. Therefore, the horizontal section 251 is positioned deeper to the right side than the left end of the lower housing 22. The front end of the cable holder 25 is positioned on the front side of the tilt pin 604 of the installation unit 602 in the front-rear direction, positioned on the left side of the steering handle 5 in the left-right direction, and positioned above the installation unit 602 and below the steering handle 5 and the lower housing 22 in the vertical direction. In this way, the horizontal section 251 is arranged at a position not overlapping with the boss 58, the handle bracket 56, and the steering handle 5 in the vertical direction. As shown for example in FIGS. 3, 5, and 7, the top end of the rising section 252 is positioned on the left side of the inverter 3 and on the rear side of the junction box 38 in a plan view from the top side.

A plurality of brackets 254 suspend the cable holder 25 below the lower housing 22 of the drive motor 2. As shown for example in FIGS. 4, 7, and 8, at least the neighborhood of the tilt pin 604 in the front-rear direction of the horizontal section 251 of the cable holder 25 is fixed to the lower housing 22 of the drive motor 2 by the bracket 254. As described, the tilt pin 604 serves as the rotation center of the tilt-up and tilt-down. Therefore, the cable holder 25 is fixed to the drive motor 2 by the bracket 254 around the rotation center of the tilt-up and tilt-down.

The first main power line 711 included in the connection cable 710 branches from the sub power line 713, the main switch line 714, and the first signal line 715 at the front section of the outboard motor main body 11 and inside of the cable holder 25. While being accommodated in the cable holder 25, the branched first main power line 711 is routed above the installation unit 602, below the steering handle 5, the boss 58, the handle bracket 56, and the lower housing 22 of the drive motor 2, and on the left side of the rotation output axis 24 of the drive motor 2 (left side in the forward direction of the ship 9). The first main power line 711 rises upward from back left oblique of the drive motor 2 and goes around the rear side to be drawn inside from the surface on the rear side of the junction box 38. The first main power line 711 is electrically connected to the inverter 3 through the junction box 38. According to the configuration, the ship operator P can be away from the first main power line 711 where high-voltage direct current flows. For example, as shown in FIG. 12, the ship operator P is generally positioned at the front right side of the outboard motor main body 11, and the ship operator P operates the steering handle 5 by left hand. Therefore, in the configuration in which the first main power line 711 passes through the lower left side of the lower housing 22 and goes around the rear side to be draw into the junction box 38, the first main power line 711 is positioned on the opposite side of the ship operator P across the inverter 3 and the drive motor 2. In this way, the first main power line 711 can be routed at a position apart from the ship operator P. The configuration can prevent the ship operator P from touching the first main power line 711. The junction box 38 is arranged on the left side of the inverter 3. For example, as shown in FIG. 6, the junction box 38 is arranged at a section with the maximum dimension in the left-right direction of the drive motor 2. Specifically, the drive motor 2 is substantially circular, and the center in the front-rear direction has the maximum dimension in the left-right direction. Therefore, the junction box 38 is arranged at the center in the front-rear direction of the drive motor 2 (shown by a center line $C_{LR}$ in FIG. 6). Therefore, the junction box 38 does not stick out from the outline of the drive motor 2 in a plan view from the top side, or the amount of sticking out is minimized.

In this way, the dimensions of the sections sticking out from the outline of the drive motor 2 are small in the cable holder 25 and the junction box 38 in a plan view from the top side. As a result, even if the outboard motor main body 11 is steered, the cable holder 25 and the junction box 38 do not enter and compress the space on the ship 9. Therefore, the space on the ship 9 can be effectively used.

As shown for example in FIGS. 3, 5, and 8, the first signal line 715, the sub power line 713, and the main switch line 714 are combined on the front side of the lower housing 22 of the drive motor 2 and branch from the first main power line 711. For example, an opening 253 (through hole) is formed on the surface of the top side near the front end of the cable holder 25. The first signal line 715, the sub power line 713, and the main switch line 714 are drawn out upward through the opening 253. The opening 253 is formed on the front side of the bracket 254 arranged near the tilt pin 604 among the brackets 254 for fixing the horizontal section 251 of the cable holder 25. The branched first signal line 715 and the sub power line 713 are drawn into the steering handle 5 through the inverter 3. Specifically, the branched first signal line 715 and the sub power line 713 pass between the boss 58, the handle bracket 56, and the front-left mounting boss 702 and reach the surface on the front side of the inverter 3. The grommet 717 is installed on the first signal line 715 and the sub power line 713, and the grommet 717 is installed on the holding unit 226 of the lower housing 22 of the drive motor 2. Therefore, the first signal line 715 and the sub power line 713 are positioned and held between the boss 58 and the handle bracket 56 and between the front-left bracket 222 of the lower housing 22 and the front-left mounting boss 702. The first signal line 715 and the sub power line 713 are drawn inside from the surface on the front side of the inverter 3. The distance between the front-left bracket 222 arranged on the lower housing 22 and the center line $C_{FR}$ is greater than the distance between the front-right bracket 221 and the center line $C_{FR}$. Therefore, a space for routing the first signal line 715 and the sub power line 713 is secured between the front-left bracket 222, the boss 58, and the handle bracket 56. The first signal line 715 and the sub power line 713 are routed between the two mounting bosses 701 and 702 on the front side. This can prevent the ship operator P and the like from touching the first signal line 715 and the sub power line 713 from the outside in the left-right direction. In this way, the first signal line 715 and the sub power line 713 drawn out from the cable holder 25 are protected by the two mounting bosses 701 and 702 on the front side.

As shown for example in FIGS. 4 and 6, the opening 253 of the cable holder 25 is formed just above or a little behind and above the tilt pin 604 and is formed behind the handle bracket 56. The first signal line 715, the sub power line 713, and the main switch line 714 branch from the first main power line 711 at the position of the opening 253. The first signal line 715 and the sub power line 713 branched from the first main power line 711 are routed toward the inverter 3 behind the handle bracket 56. According to the configuration, the first signal line 715, the sub power line 713, and the main switch line 714 are not placed between the outboard motor main body 11 and the clamp bracket 603 even if the outboard motor main body 11 is tilted up. The cable holder 25 is fixed to the lower housing 22 of the drive motor 2 through the bracket 254, near the rotation center of the tilt-up. Therefore, displacement or deformation of the section near the tilt pin of the cable holder 25 can be prevented even in the case of tilt-up. This can surely prevent the connection cable 710 from being placed between the outboard motor main body 11 and the clamp bracket 603. Even if the steering handle 5 is swung in the vertical direction, the steering handle 5 does not touch the first signal line 715 and the sub power line 713 branched from the first main power line 711. This can prevent damage of the first signal line 715 and the sub power line 713.

The first signal line 715 is drawn out from the surface on the front side of the inverter 3. The first signal line 715 heads downward by passing through substantially the same path as the path passed through when drawn into the inverter 3 and goes around below the boss 58 and the handle bracket 56 from the left side. The first signal line 715 and the sub power line 713 enter the handle bracket 56 to pass inside of the handle bracket 56 and further enter the steering handle 5.

Each of the sub power line 713 and the first signal line 715 branched from the first main power line 711 may be further divided into two at the front section of the outboard motor main body 11. In this case, one of the first signal line 715 and the sub power line 713 divided into two is drawn into the inverter 3. The first signal line 715 and the sub power line 713 are electrically connected to the inverter 3 inside of the inverter 3, and the second signal line 716 is branched from the first signal line 715 through the inverter 3. The other one of the first signal line 715 and the sub power line 713 divided into two is drawn into the steering handle 5 along with the main switch line 714, through the handle bracket 56. The first signal line 715 is electrically connected to the display unit 57, the emergency switch 52, the shift switch 53, and the throttle sensor 111 inside of the steering handle 5, and the sub power line 713 is electrically connected to the display unit 57.

The second signal line 716 branched from the first signal line 715 inside of the inverter 3 is drawn out from the surface on the front side of the inverter 3. The second signal line 716 heads downward along the front side of the inverter 3 and is drawn inside from near the front end of the surface on the top side of the upper housing 23 of the drive motor 2. The second signal line 716 drawn inside of the drive motor 2 is electrically connected to the sensor 26.

The main switch line 714 branched from the first main power line 711 is drawn inside from the bottom side of the handle bracket 56. The main switch line 714 passes inside of the handle bracket 56 and is drawn inside of the steering handle 5. The main switch 51 is electrically connected to the main switch line 714 drawn inside of the steering handle 5.

Each of the sub power line 713 and the first signal line 715 branched from the first main power line 711 may be further divided into two at the front section of the outboard motor main body 11. In this case, one of the first signal line 715 and the sub power line 713 divided into two is drawn into the inverter 3. The first signal line 715 and the sub power line 713 are electrically connected to the inverter 3 inside of the inverter 3, and the second signal line 716 is branched from the first signal line 715. The other one of the first signal line 715 and the sub power line 713 divided into two is drawn into the steering handle 5 along with the main switch line 714, through the handle bracket 56. The first signal line 715 is electrically connected to the display unit 57, the emergency switch 52, the shift switch 53, and the throttle sensor 111 inside of the steering handle 5, and the sub power line 713 is electrically connected to the display unit 57.

In this way, the connection cable 710 is accommodated in the cable holder 25 at the lower left of the steering handle 5, the handle bracket 56, and the boss 58. According to the configuration, the connection cable 710 is at a position lower than the steering handle 5 and the like, and there is no overlapping in the height direction. Even if the ship operator P operates the steering handle 5, the connection cable 710 does not touch the steering handle 5 and the like. Therefore, the connection cable 710 does not disturb a smooth steering operation. This can improve the operability of the steering operation. The steering handle 5 is positioned above the connection cable 710. Therefore, the steering handle 5 does not touch the connection cable 710 even if the steering handle 5 is folded upward around the handle bracket 56. The connection cable 710 does not touch the steering handle 5 in the steering operation or folding. This can prevent imposing unsustainable power on the connection cable 710 to damage the connection cable 710. The connection cable 710 is positioned and held by the outboard motor main body 11 while being accommodated in the cable holder 25. Therefore, movement and displacement of the connection cable 710 can be prevented even if the outboard motor main body 11 is steered or tilted up. According to the configuration, the ship operator P can be away from the first main power line 711 where the high-voltage direct current flows through. In general, as shown in FIGS. 12A and 12B, the ship operator P is positioned at the front right of the outboard motor main body 11, and the ship operator P operates the steering handle 5 by left hand. Therefore, the first main power line 711 is positioned on the opposite side of the ship operator P across the rotation output axis 24 of the drive motor 2. This can prevent or suppress the ship operator P from touching the first main power line 711. Therefore, the safety can be improved. The front end of the cable holder 25 is positioned in front of the tilt pin 604. Therefore, the connection cable 710 passes between the installation unit 602 and the lower housing 22 (particularly, above the installation unit 602) while being accommodated in the cable holder 25. The configuration can prevent the connection cable 710 from being placed between the outboard motor main body 11 and the Trans Am board 91 of the installation unit 602 or the ship 9, for example, even if the outboard motor main body 11 is tilted. This can prevent damage of the connection cable 710.

A configuration of electrical connection between the drive motor 2 and the inverter 3 will be described. Another power line 712 different from the first main power line 711 connects the drive motor 2 and the inverter 3 to allow supplying an alternating current. For the convenience of the description, the other power line 712 will be called a "second main power line 712". The alternating current converted by the inverter 3 is supplied to the drive motor 2 through the second main power line 712. The second main power line 712 electrically connects the inverter 3 and the drive motor 2 at the rear end section of the inverter 3 (section sticking out from the outline of the drive motor 2 in a plan view from the top side). In this way, the second main power line 712 is arranged on the end section of the inverter 3 that is the end section on the opposite side of the steering handle 5 (end section farther from the steering handle 5). The second main power line 712 is arranged between the two mounting bosses 703 and 704 on the rear side in the left-right direction (for example, see FIGS. 5 and 8). The second main power line 712 is arranged on the front side of the rear ends of the two mounting bosses 703 and 704 on the rear side in the front-rear direction (for example, see FIGS. 4 and 8). The second main power line 712 is drawn out substantially perpendicularly downward from the lower surface of the rear end section of the inverter 3. A terminal section 231 is arranged on the rear end of the drive motor 2, and the second main power line 712 is connected to the terminal section 231. In this way, a plurality of mounting bosses 703 and 704 are arranged on the rear side of the outboard motor main body 11, and the second main power line 712 is arranged between the plurality of mounting bosses 703 and 704.

The two brackets 223 and 224 on the rear side of the lower housing 22 project further behind the main body of the lower housing 22. Similarly, the two brackets 33 and 34 on the rear side of the inverter 3 project to the rear side from the surface on the rear side of the inverter 3. The two mounting bosses 703 and 704 on the rear side are arranged at positions projected further behind the surface on the rear side of the inverter 3 and the rear end of the drive motor 2. Therefore, the second main power line 712 is positioned between the two mounting bosses 703 and 704 on the rear side in the left-right direction and is positioned on the front side of the rear ends of the two mounting bosses 703 and 704 on the rear side in the front-rear direction. As shown for example in FIG. 6, the second main power line 712 is positioned on the front side of a virtual line connecting the rear ends of the two mounting bosses 703 and 704 on the rear side. As shown for example in FIG. 4, the second main power line 712 is hidden by the two mounting bosses 703 and 704 on the rear side and cannot be seen in a side view. As shown for example in FIGS. 5 and 8, the second main power line 712 is drawn out downward from the surface on the bottom side of the rear end section of the inverter 3. Therefore, the second main power line 712 is positioned on the front side of the surface on the rear side of the inverter 3. The second main power line 712 is hidden near the rear end of the inverter 3 and cannot been seen in a plan view from the top side (for example, see FIG. 5).

As shown for example in FIGS. 7 and 8, the carrying handle 605 protruding to the rear side from the lower housing 22 is installed on the surface on the bottom side of the lower housing 22. The carrying handle 605 includes a grip section 606 for gripping when the ship operator P or the like carries the outboard motor main body 11. The front section of the carrying handle 605 is installed on the lower housing 22, and the rear section of the carrying handle 605 projects rearward from the outboard motor main body 11. The grip section 606 is arranged on the section projecting rearward. For example, the carrying handle 605 is annular as seen from the top side. The front section is installed on the lower housing 22, and the rear section serves as the grip section 606. The rear end of the carrying handle 605 (section including the grip section 606) is positioned further behind the rear ends of the two brackets 33 and 34 on the rear side of the inverter 3, the two brackets 223 and 224 on the rear side of the lower housing 22, and the two mounting bosses 703 and 704 on the rear side. Therefore, the grip section 606 is arranged at a position separated on the rear side of the second main power line 712 as seen from the rotation output axis 24 of the drive motor 2. The dimension in the left-right direction of the carrying handle 605 is greater than the dimension in the left-right direction of the gap between the two mounting bosses 703 and 704 on the rear side. Therefore, as shown for example in FIG. 7, the carrying handle 605 overlaps with the gap between the two mounting bosses 703 and 704 on the rear side in a plan view from the bottom side. As a result, the second main power line 712 and the terminal section 231 are hidden by the carrying handle 605 and cannot be seen in a plan view from the bottom side. There is no gap between the two mounting bosses 703, 704 on the rear side and the carrying handle 605 in a plan view from the bottom side. Therefore, the carrying handle 605 prevents the ship operator P and the like from approaching the second main power line 712 from the rear side of the outboard motor main body 11. The carrying handle 605 protects the second main power line 712 when the outboard motor main body 11 is removed from the ship 9 and placed on the ground or floor. The carrying handle 605 prevents a foreign matter from touching the second main power line 712 even if the foreign matter is accidentally dropped on the outboard motor main body 11 when the outboard motor main body 11 is placed on the ground or floor. In this way, the carrying handle 605 prevents damage of the second main power line 712.

As described, the second main power line 712 is arranged on the end section of the inverter 3 that is the end section on the opposite side of the steering handle 5. The ship operator P uses the steering handle 5 to operate the outboard motor 1, and the second main power line 712 is positioned at a location significantly away from the ship operator P. This can prevent or suppress the ship operator P from touching the second main power line 712. The second main power line 712 is arranged at a deep position on the front side of the rear ends of the two mounting bosses 703 and 704 on the rear side, on the front side of the surface on the rear side of the inverter 3, and on the front side of the rear end of the carrying handle 605 (section including the grip section 606). In other words, the top, bottom, left, and right of the second main power line 712 is surrounded by the two mounting bosses 703 and 704 on the rear side, the inverter 3, and the carrying handle 605 (particularly, the grip section 606). The configuration can prevent the second main power line 712 from being touched from up, down, left, and right. The up, down, left, and right of the second main power line 712 are surrounded. Therefore, as shown in FIGS. 12A and 12B, the second main power line 712 does not move to a position viewable by the ship operator P even if the ship operator P operates the steering handle 5. This can prevent the ship operator P from touching the second main power line 712.

The first signal line 715 and the second signal line 716 are routed along the surface on the front side of the drive motor 2 and the inverter 3. The main switch line 714 branches from the first main power line 711 on the front side of the drive motor 2 and the inverter 3 and is drawn into the steering handle 5. In this way, the lines for transmitting the signals are gathered and routed on the front side of the inverter 3. Meanwhile, the second main power line 712 is routed on the surface on the rear side of the drive motor 2 and the inverter 3. More specifically, the second main power line 712 for supplying the drive motor 2 with the alternating current converted by the inverter 3 is routed on the rear side of the outboard motor main body 11. The first signal line 715, the second signal line 716, and the main switch line 714 that connect the control/power supply unit 12 and the outboard motor main body 11 to allow transfer of signals are routed on the front side of the outboard motor main body 11. In this way, the first signal line 715, the second signal line 716, and the main switch line 714 are routed at positions significantly away from the second main power line 712. The alternating current converted by the inverter 3 flows through the second main power line 712, and the second main power line 712 may generate high-frequency noise. However, the first signal line 715, the second signal line 716, and the main switch line 714 are routed on the front side of the outboard motor main body 11, and the second main power line 712 is routed on the rear side of the outboard motor main body 11. More specifically, the first signal line 715, the second signal line 716, and the main switch line 714 are arranged on the opposite side of the second main power line 712 across the inverter 3 and the drive motor 2. This can prevent or suppress the first signal line 715, the second signal line 716, and the main switch line 714 from being affected by the noise even if the second main power line 712 generates the noise. Particularly, the inverter 3 has a rectangle shape that is long in the front-rear direction in a plan view from the top side. The first signal line 715, the second signal line 716, and the main switch line 714 are gathered and routed on the end surface in one of the longitudinal directions of the inverter 3. The second main power line 712 is routed on the other end surface. This can increase the distance between the first signal line 715 and the second main power line 712 and the distance between the second signal line 716 and the second main power line 712.

Although an embodiment of the present invention has been described in detail with reference to the drawings, the embodiment has just illustrated a specific example for carrying out the present invention. The technical scope of the present invention is not to be construed in a restrictive manner by the embodiment. The present invention can be changed in various ways without departing from the spirit of the present invention, and the changes are also included in the technical scope of the present invention. For example, although the embodiment has illustrated the three-phase AC induction motor as a drive motor, the drive motor can be any AC motor, and the type is not limited. Although the inverter is substantially rectangle in a plan view from the top side in the embodiment, the shape of the inverter is not limited. The inverter can have any dimension and shape that put the inverter inside of the outline of the drive motor in a plan view from the top side, except for the rear end section.

The present invention relates to an electric outboard motor including an AC motor as a power source and including an inverter that converts a direct current to an alternating current to supply the alternating current to the AC motor.

According to the present invention, the inverter and the AC motor are stacked and arranged in the axial direction of the rotation output axis of the AC motor, and the moment of inertia of the inverter related to the rotation output axis of the drive motor is small. Therefore, the power required for the steering operation of the outboard motor main body is reduced, and the steering operation can be quickly performed. This can improve the operability of the outboard motor. The inverter falls within the outline of the AC motor in a view in the axial direction of the rotation output axis, except for part of the inverter. Therefore, even if the outboard motor main body is steered, the inverter does not enter the space on the ship regardless of the steering angle of the outboard motor main body. As a result, the space on the ship is not compressed.

What is claimed is:

1. An electric outboard motor comprising an AC motor as a drive source and provided on a ship, the electric outboard motor further comprising:

an outboard motor main body that comprises the AC motor, an inverter that converts a direct current to an alternating current to supply the alternating current to the AC motor, a drive unit, a mounting unit, and a handle;

a control/power supply unit that is provided in the ship and that supplies the direct current to the inverter; and a connection cable that electrically connects the outboard motor main body and the control/power supply unit, wherein the inverter is stacked and provided above the AC motor, the drive unit is provided on the bottom side of the AC motor, converts rotational force output by the AC motor to power for driving the ship, and includes a drive shaft, a drive shaft housing, a swivel bracket, a gear case, and a drive propeller, the drive shaft housing is combined with the swivel bracket so as to be rotated in a horizontal direction, and a center of steering of the outboard motor, a center of a rotation output axis of the AC motor and the drive shaft of the AC motor match with each other.

2. The electric outboard motor according to claim 1, wherein the rotation output axis falls within an outline of the inverter in a view in an axial direction of the rotation output axis of the AC motor.

3. The electric outboard motor according to claim 1, wherein a steering handle that steers the outboard motor main body is installed on a housing of the AC motor, and the inverter falls within an outline of the AC motor in a view in an axial direction of the rotation output axis of the AC motor, except for an end section positioned on an opposite side of a side where the steering handle is installed across the rotation output axis of the AC motor.

4. An electric outboard motor comprising an AC motor as a drive source, the electric outboard motor further comprising:

an outboard motor main body that comprises the AC motor and an inverter that converts a direct current to an alternating current to supply the alternating current to the AC motor;

a control/power supply unit that is formed separately from the outboard motor main body and that supplies the direct current to the inverter; and a connection cable that electrically connects the outboard motor main body and the control/power supply unit, wherein the inverter and the AC motor are stacked and arranged in an axial direction of a rotation output axis of the AC motor, and part of the inverter falls within an outline of the AC motor in a view in the axial direction of the rotation output axis of the AC motor, and a bracket is arranged on a housing of the AC motor, a mounting boss that rises to an opposite side of extension of the rotation output axis of the AC motor is arranged on the bracket, and the inverter is installed on the AC motor through the mounting boss.

5. The electric outboard motor according to claim 1, wherein a width direction dimension of the inverter is smaller as compared to a width direction dimension of the AC motor, and a connection section that connects, to the inverter, a power line that supplies the direct current from the control/power supply unit to the inverter is arranged on a side of the inverter in a view in the axial direction of the rotation output axis of the AC motor.

6. An electric outboard motor mounted and used in a ship, the electric outboard motor comprising:

an outboard motor main body that comprises an inverter that coverts a direct current to an alternating current and a drive motor that is driven by the alternating current converted by the inverter;

a control/power supply unit that comprises a battery unit which supplies the direct current to the inverter and that is formed separately from the outboard motor main body; and a connection cable that comprises a first main power line for supplying the direct current from the battery unit to the inverter and that electrically connects the outboard motor main body and the control/power supply unit, wherein mounting bosses are provided on a rear side of the outboard motor main body for stacking and mounting the inverter above the drive motor, a second main power line that supplies the alternating current converted by the inverter to the drive motor is arranged on the rear side of the outboard motor main body and between the mounting bosses, and the inverter and the drive motor are electrically connected by the second main power line on the rear side of the outboard motor main body.

7. The electric outboard motor according to claim 6, wherein the first main power line and the inverter are electrically connected on a port side of the ship relative to a rotation output axis of the drive motor.

8. The electric outboard motor according to claim 6, wherein the first main power line passes below the drive motor and on a port side of a rotation output axis of the drive motor, goes around the rear side of the outboard motor main body, and is electrically connected to the inverter.

9. The electric outboard motor according to claim 6, wherein a cable holder that holds the connection cable is arranged on a bottom side of the drive motor.

10. The electric outboard motor according to claim 9, wherein the cable holder has a cylindrical configuration that can accommodate the connection cable and that extends in substantially a front-rear direction, and the cable holder is fixed to the drive motor near a position of a rotation center of tilt-up of the outboard motor main body.

11. The electric outboard motor according to claim 6, wherein a carrying handle that transports the outboard motor main body is installed on the rear side of the outboard motor main body, and a grip section of the carrying handle is arranged at a position farther from a rotation output axis of the drive motor compared to the second main power line.

* * * * *